US006338396B1

(12) United States Patent
Morishita

(10) Patent No.: US 6,338,396 B1
(45) Date of Patent: Jan. 15, 2002

(54) ACTIVE MAGNETIC GUIDE SYSTEM FOR ELEVATOR CAGE

(75) Inventor: Mimpei Morishita, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/612,179

(22) Filed: Jul. 6, 2000

(30) Foreign Application Priority Data

Jul. 6, 1999 (JP) ..... 11-192224

(51) Int. Cl.[7] ..... B66B 1/34
(52) U.S. Cl. ..... 187/292; 187/393
(58) Field of Search ..... 187/292, 391–394

(56) References Cited

U.S. PATENT DOCUMENTS 4,838,172 A 6/1989 Morishita et al.
4,924,778 A 5/1990 Morishita et al.
5,379,864 A 1/1995 Colby
5,477,788 A 12/1995 Morishita
5,866,861 A 2/1999 Rajamani et al.

FOREIGN PATENT DOCUMENTS

JP 7-187552 7/1995
JP 10-114482 5/1998

*Primary Examiner*—Stanley J. Witkowski
(74) *Attorney, Agent, or Firm*—Oblon, Spivak, McClelland, Maier & Neustadt, P.C.

(57) ABSTRACT

A magnetic guide system for an elevator, including a movable unit configured to move along a guide rail, a magnet unit attached to the movable unit, having a plurality of electromagnets having magnetic poles facing the guide rail with a gap, at least two of the magnetic poles are disposed to operate attractive forces in opposite directions to each other on the guide rail, and a permanent magnet providing a magnetomotive force for guiding the movable unit, and forming a common magnetic circuit with one of the electromagnets at the gap, a sensor configured to detect a condition of the common magnetic circuit formed with the magnet unit and the guide rail, and a guide controller configured to control excitation currents to the electromagnets in response to an output of the sensor so as to stabilize the magnetic circuit.

10 Claims, 11 Drawing Sheets

ACTIVE MAGNETIC GUIDE SYSTEM FOR ELEVATOR CAGE

CROSS REFERENCE TO RELATED APPLICATION

This application claims benefit of priority to Japanese Patent Application No. 11-192224 filed Jul. 6, 1999, the entire content of which is incorporated by reference herein.

BACKGROUND OF THE INVENTION

1. Field of the Invention

This invention relates to an active magnetic guide system guiding a movable unit such as an elevator cage.

2. Description of the Background

In general, an elevator cage is hung by wire cables and is driven by a hoisting machine along guide rails vertically fixed in a hoistway. The elevator cage may shake due to load imbalance or passenger motion, since the elevator cage is hung by wire cables. The shake is restrained by guiding the cage along guide rails.

Guide systems that include wheels rolling on guide rails and suspensions, are usually used for guiding the elevator cage along the guide rails. However, unwanted noise and vibration caused by irregularities in the rail such as warps and joints, are transferred to passengers in the cage via the wheels, spoiling the comfortable ride.

In order to resolve the above problem, various alternative approaches have been proposed, which are disclosed in Japanese patent publication (Kokai) No. 51-116548, Japanese patent publication (Kokai) No. 6-336383, and Japanese patent publication (Kokai) No. 7-187552. These references disclose an elevator cage provided with electromagnets operating attractive forces on guide rails made of iron, whereby the cage may be guided without contact with the guide rails.

Japanese patent publication (Kokai) No. 7-187552 discloses an electromagnet having a pair of coils wound on an E-shaped core, which guides an elevator cage by a magnetic force. According to this technology, the comfortable ride is provided, the number of components of an electromagnet unit is reduced, the structure is simplified, and the reliability is improved.

However, in the present guide systems for elevators as described above, there are some following problems.

If a guide system is designed so as to strictly trace the guide rails, the cage may shake in response to irregularities in the rail, as a result of which a comfortable ride may worsen. Accordingly, a guide system is designed to support the elevator cage with low rigidity. However, if the cage is supported by a guide system having low rigidity, the guide system requires a large stroke in order to permit a vibration of the cage, since an amplitude of a shake of the cage becomes larger in response to disturbance forces in the guiding direction. In order to control such large stroke by using magnetic force, a gap between an electromagnet and the guide rail should be large. However, if the gap is widened, the effective flux of the electromagnet reduces due to the increase of the magnetic resistance, as a result, a guiding force for the cage remarkably reduces in proportion to the squares of the flux.

According to a magnetic guide system composed of electromagnets, an attractive force operating on guide rails is inversely proportional to the about squares of the gap and is proportional to the about squares of an excitation current. In general, a linear control is widely employed with respect to an attractive force control for an electromagnet. In this case, even if the elevator-cage stops at an appropriate position, the electromagnet is excited in a predetermined excitation current for the following reasons.

Assume that an elevator cage stops at an appropriate position. Properly speaking, it may be thought that an excitation current is set to zero, because a guiding force is not needed. However, since an attractive force of an electromagnet is proportional to the squares of the excitation current, if the attractive force is made a linear approximation on the assumption that the excitation current is zero at a steady state, a coefficient term of an infinitesimal fluctuation of a gap, and a coefficient term of an infinitesimal fluctuation of an excitation current become zero. That is, where f is an attractive force of an electromagnet, x is a gap, i is an excitation current, partial differential terms of the attraction forces with regard to the gap x and the excitation current i, which are $\partial f/\partial x$ and $\partial f/\partial i$, become zero. Consequently, it is difficult to design a linear control system.

Further, in order to obtain a satisfactory performance of the linear control system, the $\partial f/\partial x$ and the $\partial f/\partial i$ have a certain large value. The value is inversely proportional to the gap and is proportional to a magnetomotive force that at is the product of the excitation current and the number of turns of an electromagnet coil. Therefore, the $\partial f/\partial x$ and the $\partial f/\partial i$ are given appropriate values by increasing the excitation current or increasing the number of turns of the electromagnet coil. Accordingly, in case of a guide system composed of an electromagnet, in order to obtain a guide system having a satisfactory performance and a low rigidity, the electromagnet is excited with a large current in advance or an electromagnet coil having a large number of turns is used.

However, if the excitation current is made large, a cooling system is needed due to generation of heat. Further, if the number of turns of the electromagnet coil increases, the electromagnet become large in size and weight. According to a magnetic guide system composed of an electromagnet, as the magnetic guide system becomes larger, the weight gets heavier. This results in making an entire system of an elevator large, and increasing a cost.

As for a technology for restraining the generation of heat of the electromagnet coil, for example, as disclosed in Japanese patent publication (Kokai) No. 60-32581 and Japanese patent publication (Kokai) No. 61-102105, it is known that a magnetic guide system forms a common magnetic circuit made by an electromagnet and a permanent magnet at a gap between the magnetic guide system and a guide rail. The object of this technology is addressed to balance a gravitational force and an attractive force in the vertical direction of the magnetic guide system, operating on guide rail, since the technology is used for carrying articles with no contact with the guide rail. Finally, the magnetic guide system operates the attractive force on at least one guide rail in only one direction so as to support a weight of a supported material and to equalize a width of the magnetic guide system with the guide rail thereof. The supported material is guided along the guide rail by an allying force operating on the guide rail.

Generally speaking, since a weight of an elevator cage itself is supported by wire cables, it is not required that the guide rail be strong enough to receive more than a force for supporting a horizontal motion of the elevator cage. Therefore, the rigidity of the installation for the guide rails is not always high because of reducing an installation cost of the guide rails. According to an elevator having such feature, if a magnetic guide system operates an attractive force on guide rails in only one direction, the guide rails shift off the installed position. This gives rise to a difference in level at a joint of the guide rail and a deformation, thereby spoiling the comfortable ride.

Moreover, if a gap between the magnetic guide system and the guide rail is widened to reduce an attractive force operating on the guide rail, an allying force of an electromagnet reduces and the guidance by the allying force is hardly expected. In case the guidance by the allying force does not work well, an additional magnetic guide system is required. Consequently, the magnetic guide system becomes larger in size and weight, resulting in a large system for an elevator, and increasing its cost.

SUMMARY OF THE INVENTION

Accordingly, one object of this invention is to provide a magnetic guide system for an elevator, which improves a comfortable ride by restraining a shake of an elevator cage effectively.

Another object of the present invention is to provide a minimized and simplified magnetic guide system for an elevator.

Another object of the present invention is to provide a magnetic guide system for an elevator, which may not entail high cost.

The present invention provides a magnetic guide system for an elevator, including a movable unit configured to move along a guide rail, a magnet unit attached to the movable unit, having a plurality of electromagnets having magnetic poles facing the guide rail with a gap, at least two of the magnetic poles are disposed to operate attractive forces in opposite directions to each other on the guide rail, and a permanent magnet providing a magnetomotive force for guiding the movable unit, and forming a common magnetic circuit with one of the electromagnets at the gap, a sensor configured to detect a condition of the common magnetic circuit formed with the magnet unit and the guide rail, and a guide controller configured to control excitation currents to the electromagnets in response to an output of the sensor so as to stabilize the magnetic circuit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
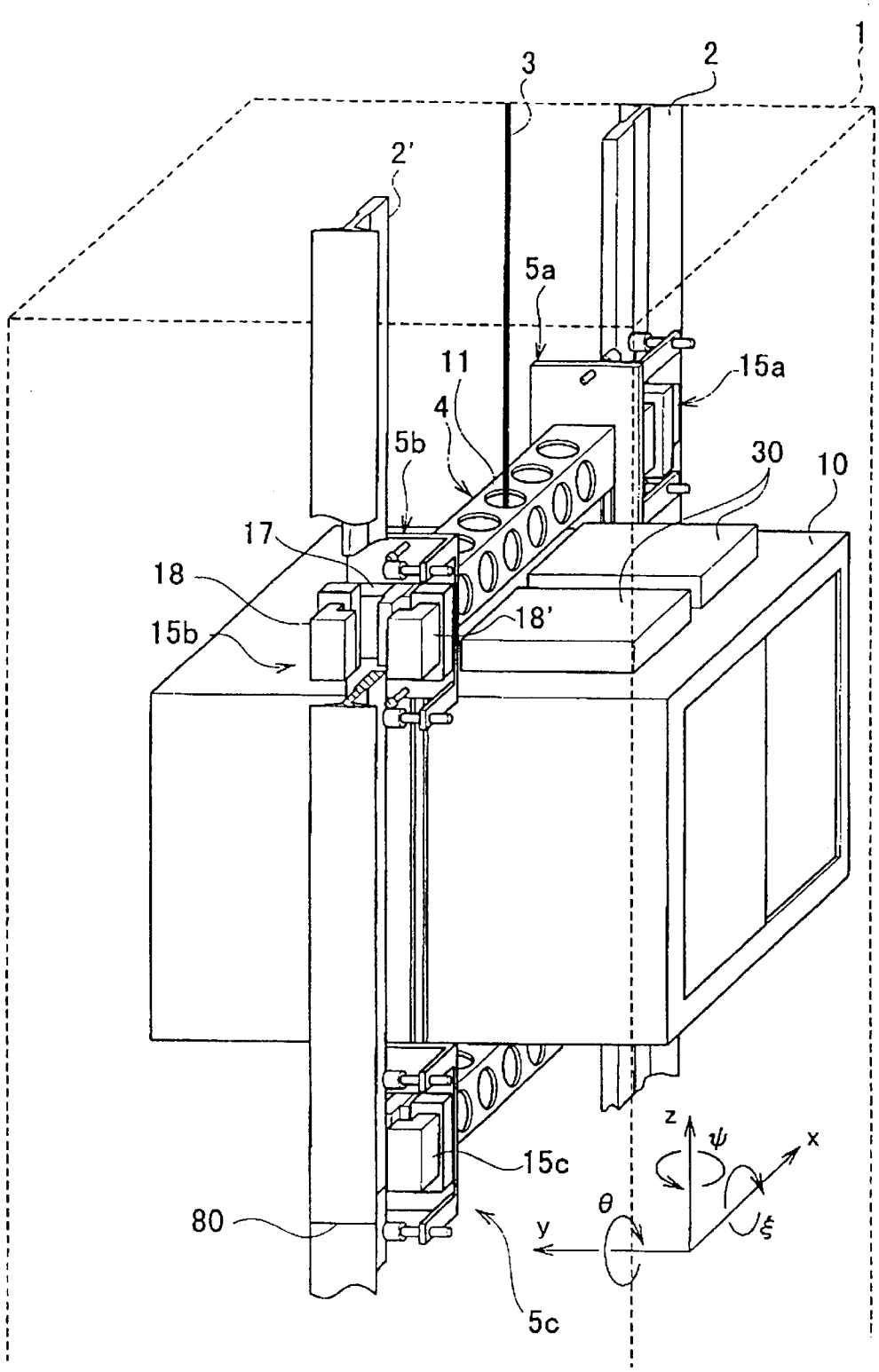
FIG. 1 is a perspective view of a magnetic guide system for an elevator cage of a first embodiment of the present invention.
Figure 2:
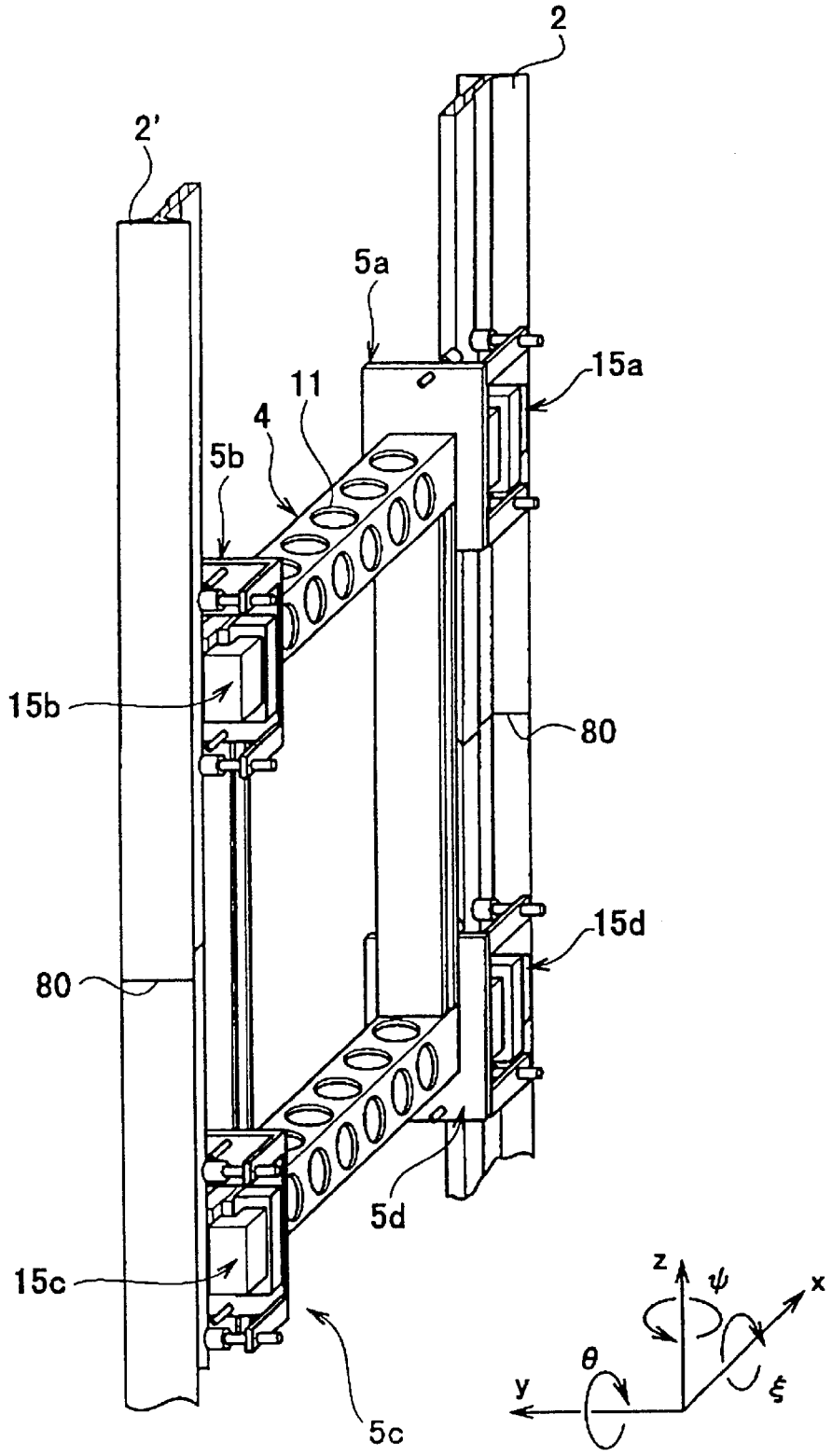
FIG. 2 is a perspective view showing a relationship between a movable unit and guide rails.

Referring now to the drawings, wherein like reference numerals designate identical or corresponding parts throughout the several views, the embodiments of the present invention are described below.

The present invention is hereinafter described in detail by way of an illustrative embodiment.

FIGS. 1 through 4 show a magnetic guide system for an elevator cage of a first embodiment of the present invention. As shown in FIG. 1, guide rails 2 and 2' made of ferromagnetic substance are disposed on the inside of a hoistway 1 by a conventional installation method. A movable unit 4 ascends and descends along the guide rails 2 and 2' by using a conventional hoisting method (not shown), for example, winding wire cables 3.

The movable unit 4 includes an elevator cage 10 for accommodating passengers and loads, and guide units 5*a*~5*d*. The guide units 5*a*~5*d* include a frame 11 having a certain strength in order to maintain respective positions of the guide units 5*a*~5*d*.

Figure 3:
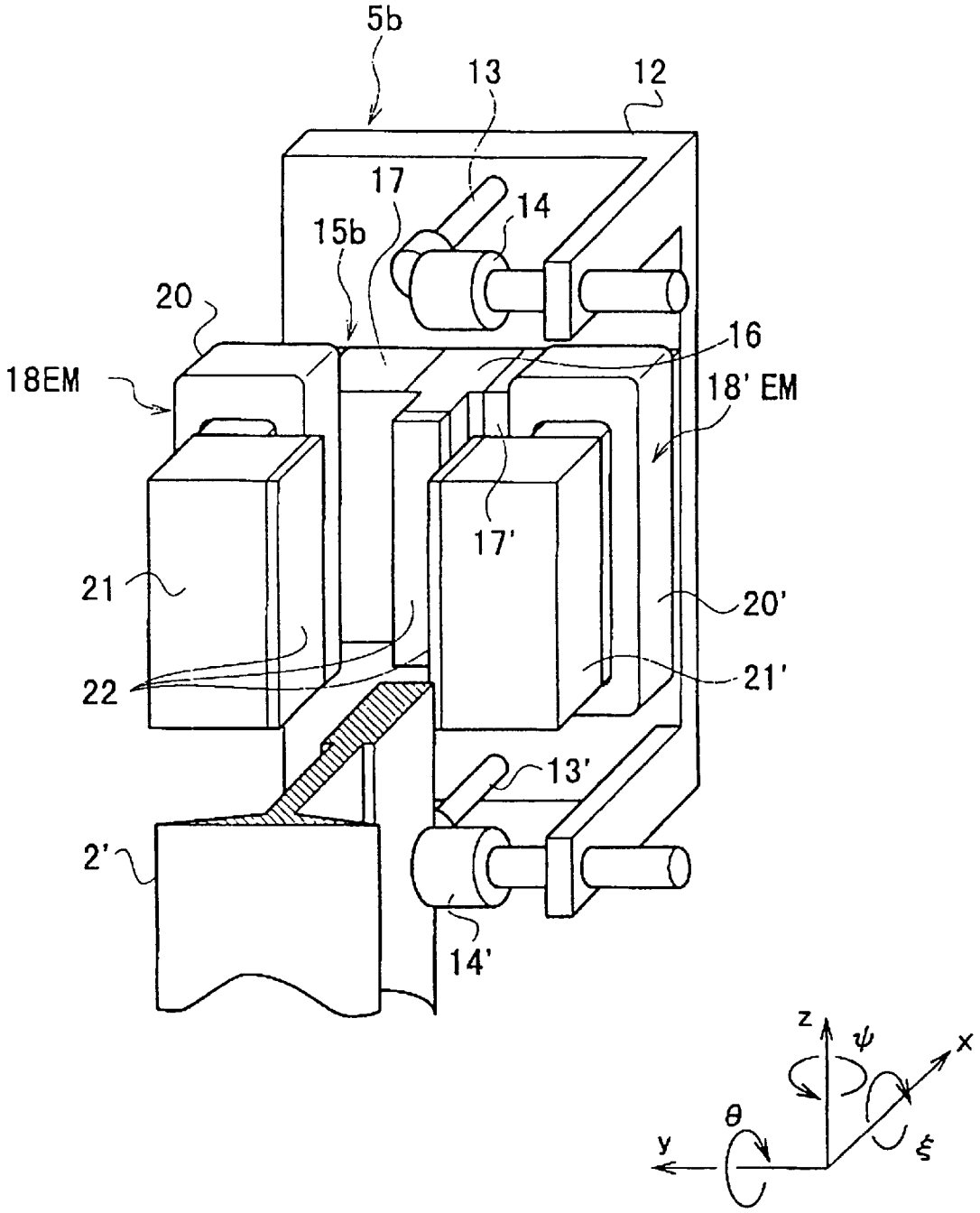
FIG. 3 is a perspective view showing a structure of a magnet unit of the magnetic guide system.
Figure 4:
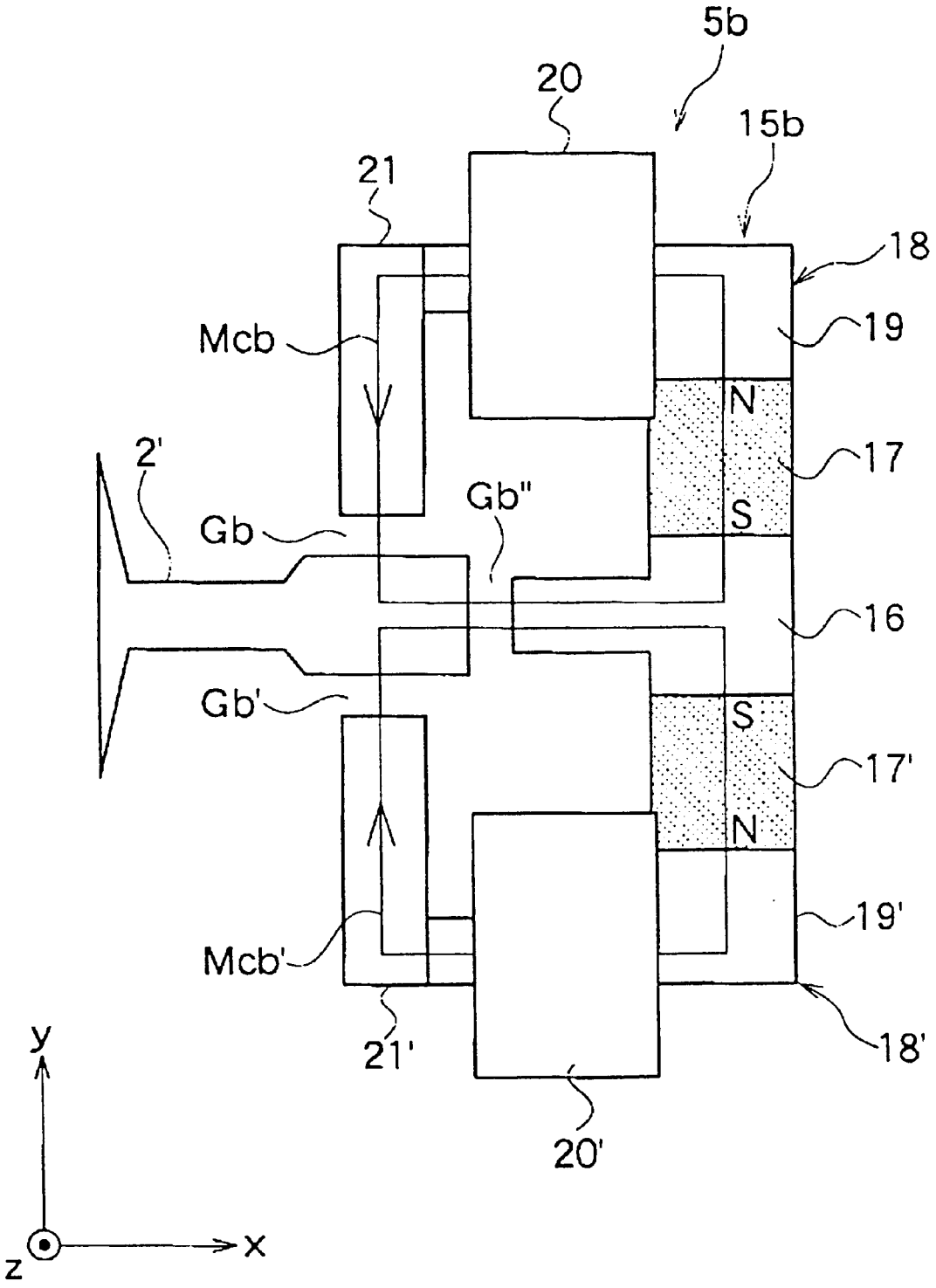
FIG. 4 is a plan view showing magnetic circuits of the magnet unit.

The guide units 5*a*~5*d* are respectively attached at the upper and lower corners of the frame 11 and face the guide rails 2 and 2' respectively. As illustrated in detail in FIGS. 3 and 4, each of the guide units 5*a*~5*d* includes a base 12 made of non-magnetic substance such as Aluminum, Stainless Steel or Plastic, an x-direction gap sensor 13, a y-direction gap sensor 14 and a magnet unit 15*b*. In FIGS. 3 and 4, only one guide unit 5*b* is illustrated, and other guide units 5*a*, 5*c* and 5*d* are the same structure as the guide unit 5*b*. A suffix "b" represents components of the guide unit 5*b*.

The magnet unit 15*b* includes a center core 16, permanent magnets 17 and 17', and electromagnets 18 and 18'. The same poles of the permanent magnets 17 and 17' are facing each other putting the center core between the permanent magnets 17 and 17', thereby forming an E-shape as a whole. The electromagnet 18 includes an L-shaped core 19, a coil 20 wound on the core 19, and a core plate 21 attached to the top of the core 19. Likewise, the electromagnet 18' includes an L-shaped core 19', a coil 20' wound on the core 19', and a core plate 21' attached to the top of the core 19'. As illustrated in detail in FIG. 3, solid lubricating materials 22 are disposed on the top portions of the center core 16 and the electromagnets 18 and 18' so that the magnet unit 15*d* does not adsorb the guide rail 2' due to an attractive force caused by the permanent magnets 17 and 17', when the electromagnets 18 and 18' are not excited. For example, a material containing Teflon, black lead or molybdenum disulfide may be used for the solid lubricating materials 22.

In the following description, to simplify an explanation of the illustrated embodiment, suffixes "a"~"d" are respectively added to figures indicating the main components of the respective guide units 5*a*~5*d* in order to distinguish them.

Figure 5:
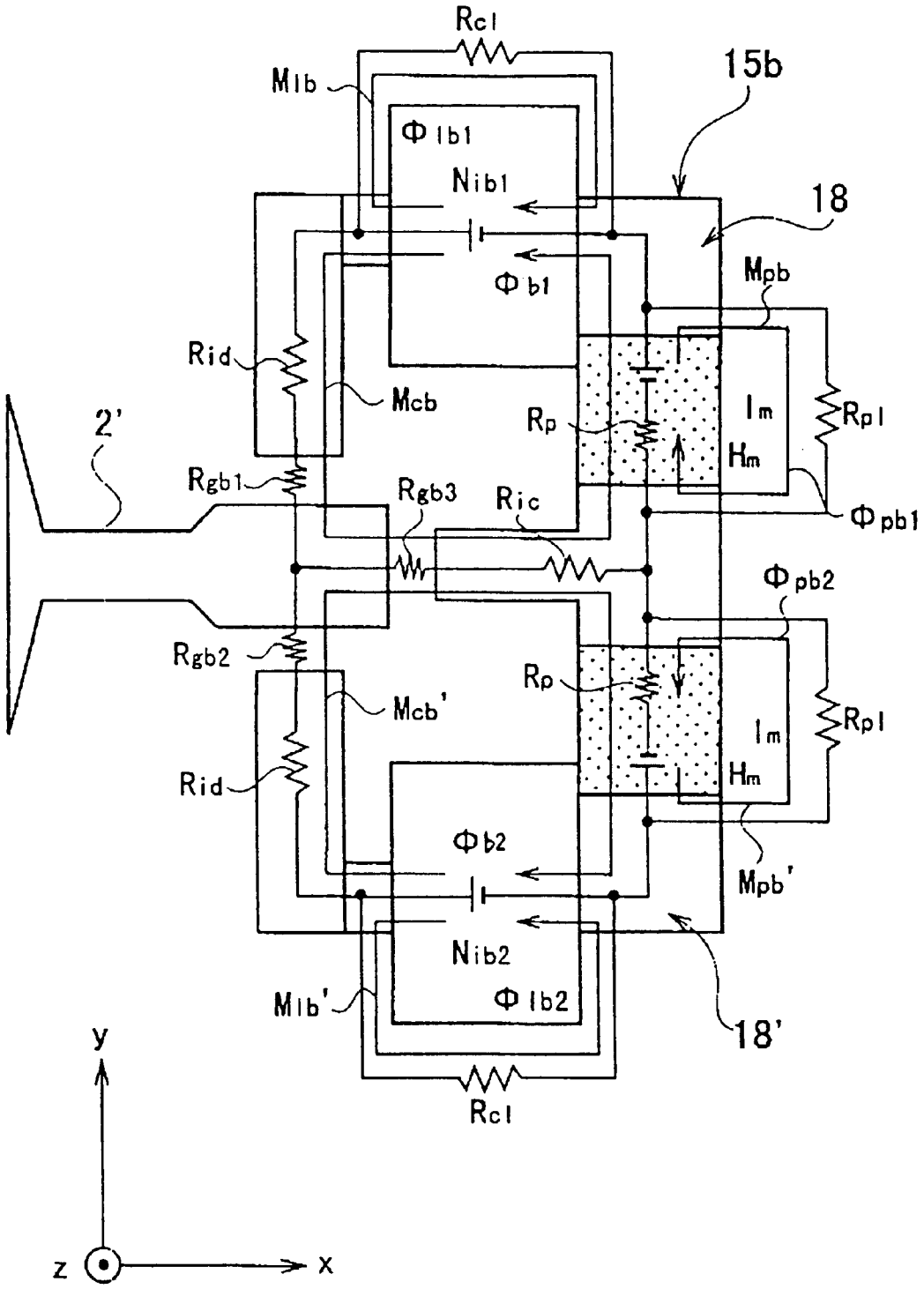
FIG. 5 shows motion characteristics of the magnetic circuits of the magnet unit.

The coils 20 and 20' of the magnet unit 15*b* are individually excited. Attractive forces in both the y-direction and x-direction operating on the guide rail 2' are individually controlled by the coils 20 and 20'. As shown in FIGS. 4 and 5, $l_m$ is a length in the polarization direction of the permanent magnets 17 and 17', $H_m$ is a coersive force, $R_{gb1}$ is a magnetic reluctance of a gap Gb between the electromagnet 18 and the guide rail 2' in a magnetic circuit Mcb formed with the permanent magnet 17, the electromagnet 18, the guide rail 2' and the center core 16, $R_{gb2}$ is a magnetic reluctance of a gap Gb' between the electromagnet 18' and the guide rail 2' in a magnetic circuit Mcb' formed with the permanent magnet,17', the electromagnet 18', the guide rail 2' and the center core 16, $R_{gb3}$ is a magnetic reluctance of a gap Gb" between the center core 16 and the guide rail 2', N is the number of turns of the coils 20 and 20', $R_{c1}$ is a magnetic reluctance in common of magnetic circuits Mlb and Mlb' concerning a leakage flux caused by magnetomotive forces of the coils 20 and 20', $R_p$ is an internal magnetic reluctance in common of the permanent magnets 17 and 17', $R_{p1}$ is a magnetic reluctance in common of magnetic circuits Mpb and Mpb' concerning a leakage flux caused by magnetomotive forces of the permanent magnets 17 and 17', $R_{ic}$ is an internal magnetic reluctance of a core which directs a common magnetic path of the magnetic circuits Mcb and Mcb', $R_{id}$ is an internal magnetic reluctance of a core which does not direct a common magnetic path of the magnetic circuits Mcb and Mcb', $i_{b1}$ and $i_{b2}$ are excitation currents of the coils 20 and 20', $\Phi_{b1}$ and $\Phi_{b2}$ are main fluxes of the magnetic circuits Mcb and Mcb', $\Phi_{lb1}$ and $\Phi_{lb2}$ are main fluxes of the magnetic circuits Mlb and Mlb', and $\Phi_{pb}$ and $\Phi_{pb2}$ are main fluxes of the magnetic circuits Mpb and Mpb', a magnetic circuit formula with respect to the magnetic circuits Mcb, Mcb', Mlb, Mlb', Mpb, and Mpb' is given by the following formula 1.

(Formula 1)

$$\begin{cases} (R_{id}+R_{gb1})\Phi_{b1}+(R_{ic}+R_{gb3})(\Phi_{b1}+\Phi_{b2})+R_p(\Phi_{b1}+\Phi_{pb1})=Ni_{b1}+H_m l_m \\ (R_{id}+R_{gb2})\Phi_{b2}+(R_{ic}+R_{gb3})(\Phi_{b1}+\Phi_{b2})+R_p(\Phi_{b2}+\Phi_{pb2})=Ni_{b2}+H_m l_m \\ R_{cl}\Phi_{lb1}=Ni_{b1} \\ R_{cl}\Phi_{lb2}=Ni_{b2} \\ R_{pl}\Phi_{pb1}+R_p(\Phi_{b1}+\Phi_{pb1})=H_m l_m \\ R_{pl}\Phi_{pb2}+R_p(\Phi_{b2}+\Phi_{pb2})=H_m l_m \end{cases}$$

In the above formula 1, $R_{gb1}$ and $R_{gb2}$ vary, when the magnet unit 15*b* moves in the y-direction, and $R_{gb3}$ varies, when the magnet unit 15*b* moves in the x-direction. In formulas 1, $\mu_0$ is a permeability in a vacuum, $S_y$ is an effective cross section of a magnetic path forming the magnetic reluctances $R_{gb1}$ and $R_{gb2}$, $S_X$ is an effective cross section of a magnetic path forming the magnetic reluctances $R_{gb3}$, $S_p$ is an effective cross section of a magnetic path forming the magnetic reluctances $R_p$, $l_r$ is the sum of gap lengths concerning the magnetic reluctances $R_{gb1}$ and $R_{gb2}$. The reluctances $R_{gb1}$, $R_{gb2}$, $R_{gb3}$ and $R_p$ are given by the following formula 2, assuming that a position of the magnet unit 15*b* where the lengths of the gaps Gb and Gb' are the same each other is a home position of the y-direction.

(Formula 2)

$$R_{gb1}=\frac{\frac{l_r}{2}+y_b}{\mu_0 S_y},\ R_{gb2}=\frac{\frac{l_r}{2}-y_b}{\mu_0 S_y},\ R_{gb3}=\frac{x_b}{\mu_0 S_x},\ R_p=\frac{l_m}{\mu_0 S_p}$$

The term $X_b$ is a length of the gap Gb" of the magnet unit $\mathbf{15}_b$. The term $Y_b$ is a change in they-direction from the home position.

To simplify calculations, assuming that the internal magnetic reluctances Rid and Ric, and leakage fluxes $\Phi_{lb1}$, $\Phi_{lb2}$, $\Phi_{pb1}$, $\Phi_{pb2}$ are small enough to be disregarded, main fluxes $\Phi_{b1}$, $\Phi_{b2}$, Of the magnet circuits Mcb and Mcb' are calculated as functions of $X_b$, $Y_b$, $i_{b1}$, $i_{b2}$ as the following formula 3.

(Formula 3)

$$\Phi_{b1}(x_b, y_b, i_{b1}, i_{b2}) = \frac{2\mu_0 S_p S_y}{l_r^2 S_p^2 S_x + 4 l_r S_p S_y (l_m S_x + S_p x_b) + 4 l_m^2 S_x S_y^2 + 8 l_m S_p S_y^2 x_b - 4 S_p^2 S_x y_b^2} \times (H_m l_m S_x (l_r S_p + 2 l_m S_y - 2 S_p y_b) + N i_{b1} (l_r S_p S_x + 2 l_m S_x S_y + 2 S_p S_y x_b - 2 S_p S_x y_b) - 2 N i_{b2} S_p S_y x_b)$$

$$\Phi_{b2}(x_b, y_b, i_{b1}, i_{b2}) = \frac{2\mu_0 S_p S_y}{l_r^2 S_p^2 S_x + 4 l_r S_p S_y (l_m S_x + S_p x_b) + 4 l_m^2 S_x S_y^2 + 8 l_m S_p S_y^2 x_b - 4 S_p^2 S_x y_b^2} \times (H_m l_m S_x (l_r S_p + 2 l_m S_y + 2 S_p y_b) - 2 N i_{b1} S_p S_y x_b + N i_{b2} (l_r S_p S_x + 2 l_m S_x S_y + 2 S_p S_y x_b + 2 S_p S_x y_b))$$

The following formula 4 shows respective attractive forces $F_{b1}$, $F_{b2}$, $F_{b3}$ of the gaps Gb, Gb', Gb' of the magnet unit 15*b*.

(Formula 4)

$$F_{b1}(x_b, y_b, i_{b1}, i_{b2}) = -\frac{1}{2\mu_0 S_y}\Phi_{b1}(x_b, y_b, i_{b1}, i_{b2})^2$$

$$F_{b2}(x_b, y_b, i_{b1}, i_{b2}) = \frac{1}{2\mu_0 S_y}\Phi_{b2}(x_b, y_b, i_{b1}, i_{b2})^2$$

$$F_{b3}(x_b, y_b, i_{b1}, i_{b2}) = -\frac{1}{2\mu_0 S_y}(\Phi_{b1}(x_b, y_b, i_{b1}, i_{b2}) + \Phi_{b2}(x_b, y_b, i_{b1}, i_{b2}))^2$$

Therefore, a force $F_{xb}$ operating the magnet unit 15*b* in the x-direction and a force $F_{yb}$ operating the magnet unit 15*b* in the y-direction are given by the following formula 5.

$$F_{xb}(X_b, Y_b, i_{b1}, i_{b2}) = F_{b3}(X_b, Y_b, i_{b1}, i_{b2})$$

$$F_{yb}(X_b, Y_b, i_{b1}, i_{b2}) = F_{b1}(X_b, Y_b, i_{b1}, i_{b2}) + F_{b2}(X_b, Y_b, i_{b1}, i_{b2}) \quad \text{(Formula 5)}$$

Where the excitation currents $i_{b1}$ and $i_{b2}$ of the electromagnets 18 and 18' are zero, the gap Gb" is $X_o$, and the magnet unit 15*b* is positioned at a home position(Y=0) of the y-axis, infinitesimal fluctuations $dF_{xb}$ and $dF_{yb}$ of attractive forces $F_{xb}$ and $F_{yb}$ concerning infinitesimal fluctuations $d_{xb}$, $d_{yb}$, $di_{b1}$ and $di_{b2}$ of $x_b$, $y_b$, $i_{b1}$ and $i_{b2}$ are given by transforming the formula 5 in accordance with the Euler's equations of motion, and then approximating in a linear equation.

(Formula 6)

$$dF_{xb} = \left(\frac{\partial F_{xb}}{\partial x_b}\right)dx_b + \left(\frac{\partial F_{xb}}{\partial y_b}\right)dy_b + \left(\frac{\partial F_{xb}}{\partial i_{b1}}\right)di_{b1} + \left(\frac{\partial F_{xb}}{\partial i_{b2}}\right)di_{b2}$$

Where xb=x0, yb=0, ib1=0 and ib2=0, partial differential in parentheses is as follows.

$$\left(\frac{\partial F_{xb}}{\partial x_b}\right) = \frac{128 H_m^2 l_m^2 \mu_0^2 S_p^3 S_x^2 S_y^3}{(l_r S_p S_x + 2 l_m S_x S_p + 4 S_p S_y x_0)^3}$$

$$\left(\frac{\partial F_{xb}}{\partial y_b}\right) = 0$$

$$\left(\frac{\partial F_{xb}}{\partial i_{b1}}\right) = \frac{-16 H_m l_m \mu_0^2 N S_p^2 S_x^2 S_y^2}{(l_r S_p S_x + 2 l_m S_x S_p + 4 S_p S_y x_0)^2}$$

-continued $$\left(\frac{\partial F_{xb}}{\partial i_{b2}}\right) = \frac{-16H_m l_m \mu_0^2 N S_p^2 S_x^2 S_y^2}{(l_r S_p S_x + 2l_m S_x S_p + 4S_p S_y x_0)^2}$$

$$dF_{xb} = \left(\frac{\partial F_{xb}}{\partial x_b}\right)dx_b + \left(\frac{\partial F_{xb}}{\partial y_b}\right)dy_b + \left(\frac{\partial F_{xb}}{\partial i_{b1}}\right)di_{b1} + \left(\frac{\partial F_{xb}}{\partial i_{b2}}\right)di_{b2} \quad \text{(Formula 7)}$$

$$\left(\frac{\partial F_{yb}}{\partial x_b}\right) = 0$$

$$\left(\frac{\partial F_{yb}}{\partial y_b}\right) = \frac{32H_m^2 l_m^2 \mu_0^2 S_p^3 S_x^2 S_y^2}{(l_r S_p + 2l_m S_y)(l_r S_p S_x + 2l_m S_x S_y + 4S_p S_y x_0)^2}$$

$$\left(\frac{\partial F_{yb}}{\partial i_{b1}}\right) = \frac{-8H_m l_m \mu_0^2 N S_p^2 S_x S_y^2}{(l_r S_p + 2l_m S_y)(l_r S_p S_x + 2l_m S_x S_y + 4S_p S_y x_0)}$$

$$\left(\frac{\partial F_{yb}}{\partial i_{b2}}\right) = \frac{8H_m l_m \mu_0^2 N S_p^2 S_x S_y^2}{(l_r S_p + 2l_m S_y)(l_r S_p S_x + 2l_m S_x S_y + 4S_p S_y x_0)}$$

According to the above formulas, it is realized that the $F_{xb}$ does not change, even if the magnet unit 15*b* shifts a little in the y-direction, and further the $F_{yb}$ does not change, even if the magnet unit 15*b* shifts a little in the x-direction. Moreover, since the following formula 8 is set up, if $F_x$ is $(i_{b1}+i_{b2})$, and $F_y$ is $(i_{b1}-i_{b2})$, it is realized that the $F_x$ and $F_y$ may be controlled individually.

$$\frac{\partial F_{xb}}{\partial i_{b1}} = \frac{\partial F_{xb}}{\partial i_{b2}},\ \frac{\partial F_{yb}}{\partial i_{b1}} = -\frac{\partial F_{yb}}{\partial i_{b2}} \quad \text{(Formula 8)}$$

All partial differential terms contain a coefficient of magnetomotive forces $H_m l_m$ of the permanent magnets 17 and 17'. Consequently, if the magnet unit 15*b* does not include a permanent magnet, and the magnetomotive force is zero, all partial differential terms become zero, and as a result, attractive forces of the magnet unit 15 may not be controlled. That is, if a magnet unit includes only electromagnets, the magnet unit may not control attractive force where excitation currents for the electromagnets are near zero. Values of all partial differential terms in the formula 6 and 7 are made large enough by selecting a permanent magnet having a large residual magnetic flux density and coersive force which contains Samarium-Cobalt or Neodymium-Iron-Boron(Nd—Fe—B) as the main ingredients, thereby facilitating an attractive force control by an excitation current to electromagnets. In the following descriptions, parentheses for partial differential are omitted for convenience at a steady state, that is, $x=x_0$, $y=0$, $i_{b1}=0$, $i_{b2}=0$.

Likewise, where attractive forces in the x-direction of the magnet units 15*a*, 15*c* and 15*d* are put into $F_{xa}$, $F_{xc}$ and $F_{xd}$ respectively, and attractive forces in the y-direction of the magnet units 15*a*, 15*c* and 15*d* are put into $F_{ya}$, $P_{yc}$ and $F_{yd}$ respectively, the following formulas 9 and 10 are obtained.

$$\frac{\partial F_{xa}}{\partial x_a} = -\frac{\partial F_{xb}}{\partial x_b},\ \frac{\partial F_{xa}}{\partial y_a} = 0,$$
$$\frac{\partial F_{xa}}{\partial i_{a1}} = -\frac{\partial F_{xb}}{\partial i_{b1}},\ \frac{\partial F_{xa}}{\partial i_{a2}} = -\frac{\partial F_{xb}}{\partial i_{b2}}$$
$$\frac{\partial F_{xc}}{\partial x_c} = \frac{\partial F_{xb}}{\partial x_b},\ \frac{\partial F_{xc}}{\partial y_c} = 0,$$
$$\frac{\partial F_{xc}}{\partial i_{c1}} = \frac{\partial F_{xb}}{\partial i_{b1}},\ \frac{\partial F_{xc}}{\partial i_{c2}} = \frac{\partial F_{xb}}{\partial i_{b2}}$$
$$\frac{\partial F_{xd}}{\partial x_d} = -\frac{\partial F_{xb}}{\partial x_b},\ \frac{\partial F_{xd}}{\partial y_d} = 0,$$
$$\frac{\partial F_{xd}}{\partial i_{d1}} = -\frac{\partial F_{xb}}{\partial i_{b1}},\ \frac{\partial F_{xd}}{\partial i_{d2}} = -\frac{\partial F_{xb}}{\partial i_{b2}} \quad \text{(Formula 9)}$$

$$\frac{\partial F_{ya}}{\partial x_a} = 0,\ \frac{\partial F_{ya}}{\partial y_a} = \frac{\partial F_{yb}}{\partial y_b},$$
$$\frac{\partial F_{ya}}{\partial i_{a1}} = \frac{\partial F_{yb}}{\partial i_{b1}},\ \frac{\partial F_{ya}}{\partial i_{a2}} = \frac{\partial F_{yb}}{\partial i_{b2}}$$
$$\frac{\partial F_{yc}}{\partial x_c} = 0,\ \frac{\partial F_{yc}}{\partial y_c} = \frac{\partial F_{yb}}{\partial y_b},$$
$$\frac{\partial F_{yc}}{\partial i_{c1}} = \frac{\partial F_{yb}}{\partial i_{b1}},\ \frac{\partial F_{yc}}{\partial i_{c2}} = \frac{\partial F_{yb}}{\partial i_{b2}}$$
$$\frac{\partial F_{yd}}{\partial x_d} = 0,\ \frac{\partial F_{yd}}{\partial y_d} = \frac{\partial F_{yb}}{\partial y_b},$$
$$\frac{\partial F_{yd}}{\partial i_{d1}} = \frac{\partial F_{yb}}{\partial i_{b1}},\ \frac{\partial F_{yd}}{\partial i_{d2}} = \frac{\partial F_{yb}}{\partial i_{b2}} \quad \text{(Formula 10)}$$

The above respective partial differentials of the magnet units 15*a*, 15*c* and 15*d* are in a condition of $x_a=x_0$, $y_a=0$, $i_{a1}=0$, $i_{a2}=0$, $x_{b1}=xc0$, $y_b=0$, $i_{b1}=0$, $i_{b2}=0$, $x_c=x_0$, $y_c=0$, $i_{c1}=0$, $i_{c2}=0$, $X_d=x_0$, $y_d=0$, $i_{d1}=0$ and $i_{d2}=0$.

Further, infinitesimal fluctuations of the main fluxes $\Phi_{b1}$ and $\Phi_{b2}$ in reference to x, y, $i_{b1}$ and $i_{b2}$ are given by the following formulas 11 and 12.

$$d\Phi_{b1} = \left(\frac{\partial \Phi_{b1}}{\partial x_b}\right)dx_b + \left(\frac{\partial \Phi_{b2}}{\partial y_b}\right)dy_b + \left(\frac{\partial \Phi_{b2}}{\partial i_{b1}}\right)di_{b1} + \left(\frac{\partial \Phi_{b1}}{\partial i_{b2}}\right)di_{b2} \quad \text{(Formula 11)}$$

$$\begin{cases} \left(\frac{\partial \Phi_{b1}}{\partial x_b}\right) = \frac{-8H_m l_m \mu_0 S_p^2 S_x S_y^2}{(l_r S_p S_x + 2l_m S_x S_y + 4S_p S_y x_0)^2} \\ \left(\frac{\partial \Phi_{b1}}{\partial y_b}\right) = \frac{-4H_m l_m \mu_0 S_p^2 S_x S_y}{(l_r S_p + 2l_m S_y)(l_r S_p S_x + 2l_m S_x S_y + 4S_p S_y x_0)} \\ \left(\frac{\partial \Phi_{b1}}{\partial i_{b1}}\right) = \frac{2\mu_0 N S_p S_y (l_r S_p S_x + 2l_m S_x S_y + 2S_p S_y x_0)}{(l_r S_p + 2l_m S_y)(l_r S_p S_x + 2l_m S_x S_y + 4S_p S_y x_0)} \\ \left(\frac{\partial \Phi_{b1}}{\partial i_{b2}}\right) = \frac{-4\mu_0 N S_p^2 S_y^2 x_0}{(l_r S_p + 2l_m S_y)(l_r S_p S_x + 2l_m S_x S_y + 4S_p S_y x_0)} \end{cases}$$

$$d\Phi_{b2} = \left(\frac{\partial \Phi_{b2}}{\partial x_b}\right)dx_b + \left(\frac{\partial \Phi_{b2}}{\partial y_b}\right)dy_b + \left(\frac{\partial \Phi_{b2}}{\partial i_{b1}}\right)di_{b1} + \left(\frac{\partial \Phi_{b2}}{\partial i_{b2}}\right)di_{b2} \quad \text{(Formula 12)}$$

$$\begin{cases} \left(\frac{\partial \Phi_{b2}}{\partial x_b}\right) = \frac{-8H_m l_m \mu_0 S_p^2 S_x S_y^2}{(l_r S_p S_x + 2l_m S_x S_y + 4S_p S_y x_0)^2} \\ \left(\frac{\partial \Phi_{b2}}{\partial y_b}\right) = \frac{-4H_m l_m \mu_0 S_p^2 S_x S_y}{(l_r S_p + 2l_m S_y)(l_r S_p S_x + 2l_m S_x S_y + 4S_p S_y x_0)} \\ \left(\frac{\partial \Phi_{b2}}{\partial i_{b1}}\right) = \frac{-4\mu_0 N S_p^2 S_y^2 x_0}{(l_r S_p + 2l_m S_y)(l_r S_p S_x + 2l_m S_x S_y + 4S_p S_y x_0)} \\ \left(\frac{\partial \Phi_{b2}}{\partial i_{b2}}\right) = \frac{2\mu_0 N S_p S_y (l_r S_p S_x + 2l_m S_x S_y + 2S_p S_y x_0)}{(l_r S_p + 2l_m S_y)(l_r S_p S_x + 2l_m S_x S_y + 4S_p S_y x_0)} \end{cases}$$

Where an amount of an infinitesimal fluctuation is represented by a mark Δ, currents ib1 and ib2 flowing in the coils 20 and 20' are presented by the following voltage equations 13 and 14.

$$L_{x0}\Delta i'_{b1} + M_{x0}\Delta i'_{b2} = -N\frac{\partial\Phi_{b1}}{\partial x}\Delta x'_b - N\frac{\partial\Phi_{b1}}{\partial y}\Delta y'_b - R\Delta i_{b1} + e_{b1} \quad \text{(Formula 13)}$$

$$L_{x0} = L_\infty + N\frac{\partial\Phi_{b1}}{\partial i_{b1}},\ M_{x0} = N\frac{\partial\Phi_{b1}}{\partial i_{b1}}$$

Symbols "'" represent a first differentiation.

$$L_{x0}\Delta i'_{b1} + M_{x0}\Delta i'_{b2} = -N\frac{\partial\Phi_{b2}}{\partial x}\Delta x'_b - N\frac{\partial\Phi_{b2}}{\partial y}\Delta y'_b - R\Delta i_{b2} + e_{b2} \quad \text{(Formula 14)}$$

$$L_{x0} = L_\infty + N\frac{\partial\Phi_{b2}}{\partial i_{b2}},\ M_{x0} = N\frac{\partial\Phi_{b2}}{\partial i_{b2}}$$

In case of controlling attractive forces $F_x$ and $F_y$ individually, voltage equations for excitation current are as follows.

Where an excitation current condition is presented ($i_{b1}+i_{b2}$), $$(L_{x0}+M_{x0})\Delta i'_{xb} = -N\frac{\partial\Phi_{b1}}{\partial x_b}\Delta x'_b - R\Delta i_{xb} + e_{xb} \quad \text{(Formula 15)}$$

$$i_{xb} = i_{b1} + \frac{i_{b2}}{2},\ e_{xb} = \frac{e_{b1}+e_{b2}}{2}$$

Where an excitation current condition is presented ($i_{b1}-i_{b2}$) , $$(L_{x0}-M_{x0})\Delta i'_{yb} = -N\frac{\partial\Phi_{b1}}{\partial y_b}\Delta y'_b - R\Delta i_{yb} + e_{yb}$$

$$i_{yb} = \frac{i_{b1}-i_{b2}}{2},\ e_{yb} = \frac{e_{b1}-e_{b2}}{2}$$

Likewise, with respect to the magnet units 15*a*, 15*c* and 15*d*, the respective voltage equations in conditions of ($i_{a1}+i_{a2}$), ($i_{c1}+i_{c2}$) and ($i_{d1}+i_{d2}$) are as follows.

$$(L_{x0}+M_{x0})\Delta i'_{xa} = -N\frac{\partial\Phi_{a1}}{\partial x_a}\Delta x'_a - R\Delta i_{xa} + e_{xa} \quad \text{(Formula 17)}$$

$$i_{xa} = i_{a1} + \frac{i_{a2}}{2},\ e_{xa} = \frac{e_{a1}+e_{a2}}{2}$$

$$(L_{x0}+M_{x0})\Delta i'_{xc} = -N\frac{\partial\Phi_{c1}}{\partial x_c}\Delta x'_c - R\Delta i_{xc} + e_{xc} \quad \text{(Formula 18)}$$

$$i_{xc} = i_{c1} + \frac{i_{c2}}{2},\ e_{xc} = \frac{e_{c1}+e_{c2}}{2}$$

$$(L_{x0}+M_{x0})\Delta i'_{xd} = -N\frac{\partial\Phi_{d1}}{\partial x_d}\Delta x'_d - R\Delta i_{xd} + e_{xd} \quad \text{(Formula 19)}$$

$$i_{xd} = \frac{i_{d1}+i_{d2}}{2},\ e_{xd} = \frac{e_{d1}+e_{d2}}{2}$$

Where excitation current conditions are respectively presented ($i_{a1}-i_{a2}$), ($i_{c1}-i_{c2}$) *and* ($i_{d1}-i_{d2}$) , $$(L_{x0}-M_{x0})\Delta i'_{ya} = -N\frac{\partial\Phi_{a1}}{\partial y_a}\Delta y'_a - R\Delta i_{ya} + e_{ya} \quad \text{(Formula 20)}$$

$$i_{ya} = \frac{i_{a1}-i_{a2}}{2},\ e_{ya} = \frac{e_{a1}-e_{a2}}{2}$$

-continued $$(L_{x0}-M_{x0})\Delta i'_{yc} = -N\frac{\partial\Phi_{c1}}{\partial y_c}\Delta y'_c - R\Delta i_{yc} + e_{yc} \quad \text{(Formula 21)}$$

$$i_{yc} = \frac{i_{c1}-i_{c2}}{2},\ e_{yc} = \frac{e_{c1}-e_{c2}}{2}$$

$$(L_{x0}-M_{x0})\Delta i'_{yd} = -N\frac{\partial\Phi_{d1}}{\partial y_d}\Delta y'_d - R\Delta i_{yd} + e_{yd} \quad \text{(Formula 22)}$$

$$i_{yd} = \frac{i_{d1}-i_{d2}}{2},\ e_{yd} = \frac{e_{d1}-e_{d2}}{2}$$

A relationship of the respective main fluxes $\Phi_{a1}$, $\Phi_{a2}$, $\Phi_{b1}$, $\Phi_{b2}$, $\Phi_{c1}$, $\Phi_{c2}$, $\Phi_{d1}$, $\Phi_{d2}$ of the magnet units 15*a*~15*d* is presented by the following formulas 23 and 24.

$$\begin{aligned}
&\frac{\partial\Phi_{a1}}{\partial x_a} = \frac{\partial\Phi_{b1}}{\partial x_b},\ \frac{\partial\Phi_{a1}}{\partial y_a} = \frac{\partial\Phi_{b1}}{\partial y_b},\\
&\frac{\partial\Phi_{a1}}{\partial i_{a1}} = \frac{\partial\Phi_{b1}}{\partial i_{b1}},\ \frac{\partial\Phi_{a1}}{\partial i_{a2}} = \frac{\partial\Phi_{b1}}{\partial i_{b2}}\\
&\frac{\partial\Phi_{c1}}{\partial x_c} = \frac{\partial\Phi_{b1}}{\partial x_b},\ \frac{\partial\Phi_{c1}}{\partial y_c} = \frac{\partial\Phi_{b1}}{\partial y_b},\\
&\frac{\partial\Phi_{c1}}{\partial i_{c1}} = \frac{\partial\Phi_{b1}}{\partial i_{b1}},\ \frac{\partial\Phi_{c1}}{\partial i_{c2}} = \frac{\partial\Phi_{b1}}{\partial i_{b2}}\\
&\frac{\partial\Phi_{d1}}{\partial x_d} = \frac{\partial\Phi_{b1}}{\partial x_b},\ \frac{\partial\Phi_{d1}}{\partial y_d} = \frac{\partial\Phi_{b1}}{\partial y_b},\\
&\frac{\partial\Phi_{d1}}{\partial i_{d1}} = \frac{\partial\Phi_{b1}}{\partial i_{b1}},\ \frac{\partial\Phi_{d1}}{\partial i_{d2}} = \frac{\partial\Phi_{b1}}{\partial i_{b2}}
\end{aligned} \quad \text{(Formula 23)}$$

$$\begin{aligned}
&\frac{\partial\Phi_{a2}}{\partial x_a} = \frac{\partial\Phi_{b1}}{\partial x_b},\ \frac{\partial\Phi_{a2}}{\partial y_a} = -\frac{\partial\Phi_{b1}}{\partial y_b},\\
&\frac{\partial\Phi_{a2}}{\partial i_{a1}} = \frac{\partial\Phi_{b1}}{\partial i_{b2}},\ \frac{\partial\Phi_{a2}}{\partial i_{a2}} = \frac{\partial\Phi_{b1}}{\partial i_{b1}}\\
&\frac{\partial\Phi_{b2}}{\partial x_b} = \frac{\partial\Phi_{b1}}{\partial x_b},\ \frac{\partial\Phi_{b2}}{\partial y_b} = -\frac{\partial\Phi_{b1}}{\partial y_b},\\
&\frac{\partial\Phi_{b2}}{\partial i_{b1}} = \frac{\partial\Phi_{b1}}{\partial i_{b2}},\ \frac{\partial\Phi_{b2}}{\partial i_{b2}} = \frac{\partial\Phi_{b1}}{\partial i_{b1}}\\
&\frac{\partial\Phi_{c2}}{\partial x_c} = \frac{\partial\Phi_{b1}}{\partial x_b},\ \frac{\partial\Phi_{c2}}{\partial y_c} = -\frac{\partial\Phi_{b1}}{\partial y_b},\\
&\frac{\partial\Phi_{c2}}{\partial i_{c1}} = \frac{\partial\Phi_{b1}}{\partial i_{b2}},\ \frac{\partial\Phi_{c2}}{\partial i_{c2}} = \frac{\partial\Phi_{b1}}{\partial i_{b2}}\\
&\frac{\partial\Phi_{d2}}{\partial x_d} = \frac{\partial\Phi_{b1}}{\partial x_b},\ \frac{\partial\Phi_{d2}}{\partial y_d} = \frac{\partial\Phi_{b1}}{\partial y_b},\\
&\frac{\partial\Phi_{d2}}{\partial i_{d1}} = \frac{\partial\Phi_{b1}}{\partial i_{b2}},\ \frac{\partial\Phi_{d2}}{\partial i_{d2}} = \frac{\partial\Phi_{b1}}{\partial i_{b2}}
\end{aligned} \quad \text{(Formula 24)}$$

Figure 6:
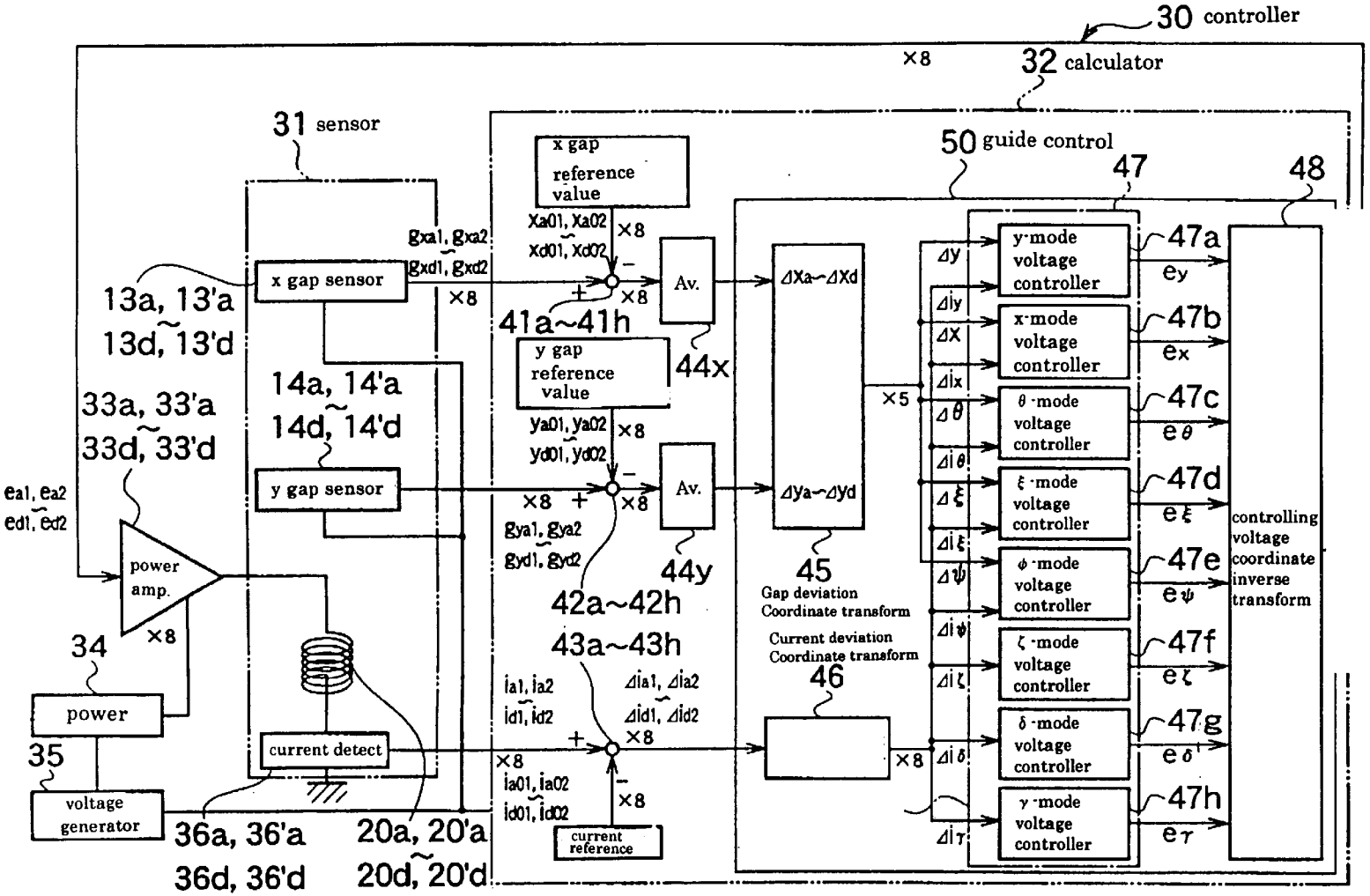
FIG. 6 is a block diagram showing a circuit of a controller.

The attractive forces of the guide units 5*a*~5*d* are controlled by a controller 30 in FIG. 6, whereby the movable unit 4 are guided along the guide rails 2 and 2' with no contact.

The controller 30 is divided as shown in FIG. 1, but functionally combined as a whole as shown in FIG. 6. The following is an explanation of the controller 30. In FIG. 6, arrows represent signal paths, and solid lines represent electric power lines around coils 20*a*, 20'*a*~20*d*, 20'*d*. The controller 30, which is attached on the elevator cage 4, includes a sensor 31 detecting variations in magnetomotive forces or magnetic reluctances of magnetic circuits formed with the magnet units 15*a*~15*d*, or in a movement of the movable unit 4, a calculator 32 calculating voltages operating on the coils 20*a*, 20'*a*~20*d*, 20'*d* on the basis of signals from the sensor 31 in order for the movable unit 4 to be guided with no contact with the guide rails 2 and 2', power amplifiers 33*a*, 33'*a* ~33*d*, 33'*d* supplying an electric power to the coils 20*a*, 20'*a* ~20*d*, 20'*d* on the basis of an output of the calculator 32, whereby attractive forces in the x and y directions of the magnet units 15*a*~15*d* are individually controlled.

A power line 34 supplies an electric power to the power amplifiers 33*a*, 33'*a*~33*d*, 33'*d* and also supplies an electric power to a constant voltage generator 35 supplying an electric power having a constant voltage to the calculator 32, the x-direction gap sensors 13*a*, 13'*a*~13*d*, 13'*d* and the y-direction gap sensors 14*a*, 14'*a*~14*d*, 14'*d*. A power supply 34 functions to transform an alternating current power, which is supplied from the outside of the hoistway 1 with a power line (not shown), into an appropriate direct current power in order to supply the direct current power to the power amplifiers 33*a*, 33'*a* ~33*d*, 33'*d* for lighting or opening and closing doors.

The constant voltage generator 35 supplies an electric power with a constant voltage to the calculator 32 and the gap sensors 13 and 14, even if a voltage of the power supply 34 varies due to an excessive current supply, whereby the calculator 32 and the gap sensors 13 and 14 may normally operate.

The sensor 31 includes the x-direction gap sensors 13*a*, 13'*a*~13*d*, 13'*d*, the y-direction gap sensors 14*a*, 14'*a*~14*d*, 14'*d* and current detectors 36*a*, 36'*a*~36*d*, 36'*d* detecting current values of the coils 20*a*, 20'*a*~20*d*, 20'*d*.

The calculator 32 controls magnetic guide controls for the movable unit 4 in every motion coordinate system shown in FIG. 1. The motion coordinate system is constituted of a y-mode (back and forth motion mode) representing a right and left motion along a y-coordinate on a center of the movable unit 4, an x-mode(right and left motion mode) representing a right and left motion along a x-coordinate, a θ-mode(roll mode) representing a rolling around the center of the movable unit 4, a ξ-mode (pitch mode) representing a pitching around the center of the movable unit 4, a ϕ-mode(yaw-mode) representing a yawing around the center of the movable unit 4. In addition to the above modes, the calculator 32 also controls every attractive force of the magnet units 15*a*~15*d* operating on the guide rails, a torsion torque around the y-coordinate caused by the magnet units 15*a*~15*d*, operating on the frame 11, and a torque straining the frame 11 symmetrically, caused by rolling torques that a pair of magnet units 15*a* and 15*d*, and a pair of magnet units 15*b* and 15*c* operate on the frame 11. In brief, the calculator 32 additionally controls a ζ-mode (attractive mode), a δ-mode (torsion mode) and a γ-mode (strain mode). Accordingly, the calculator 32 controls in a way that excitation currents of coils 20 converge to zero in the above described eight modes, which is so-called zero power control, in order to keep the movable unit 4 steady by only attractive forces of the permanent magnets 17 and 17' irrespective of a weight of a load.

This control method is disclosed in detail in Japanese Patent Publication(Kokai) No. 6-178409. However, the theory such control is based on is explained, since the four magnet units 15*a*~15*d* control to guide the movable unit 4 in this embodiment.

To simplify the explanation, it is assumed that a center of the movable unit 4 exists on a vertical line crossing a diagonal intersection point of the center points of the magnet units 15*a*~15*d* disposed on four corners of the movable unit 4. The center is regarded as the origin of respective x, y and z coordinate axes. If a motion equation in every mode of magnetic levitation control system with respect to a motion of the movable unit 4, and voltage equations of exciting voltages applying to the electromagnets 18 and 18' of the magnet units 15*a*~15*d* are linearized around a steady point, the following formulas 25 through 29 are obtained.

(Formula 25)

$$\begin{cases} M\Delta y'' = 4\dfrac{\partial F_{ya}}{\partial y_a}\Delta y + 4\dfrac{\partial F_{ya}}{\partial i_{al}}\Delta i_y + U_y \\ (L_{x0} - M_{x0})\Delta i_y' = -N\dfrac{\partial \Phi_{bl}}{\partial y_a}\Delta y' - R\Delta i_y + e_y \end{cases}$$

$$\Delta y = \frac{\Delta y_a + \Delta y_b + \Delta y_c + \Delta y_d}{4}$$

$$\Delta i_y = \frac{\Delta i_{ya} + \Delta i_{yb} + \Delta i_{yc} + \Delta i_{yd}}{4}$$

$$e_y = \frac{\Delta e_{ya} + \Delta e_{yb} + \Delta e_{yc} + \Delta e_{yd}}{4}$$

(Formula 26)

$$\begin{cases} M\Delta x'' = 4\dfrac{\partial F_{xb}}{\partial x_b}\Delta x + 4\dfrac{\partial F_{xb}}{\partial i_{bl}}\Delta i_x + U_x \\ (L_{x0} + M_{x0})\Delta i_x' = -N\dfrac{\partial \Phi_{bl}}{\partial x_b}\Delta x' - R\Delta i_x + e_x \end{cases}$$

$$\Delta x = \frac{-\Delta x_a + \Delta x_b + \Delta x_c - \Delta x_d}{4}$$

$$\Delta i_x = \frac{-\Delta i_{xa} + \Delta i_{xb} + \Delta i_{xc} - \Delta i_{xd}}{4}$$

$$e_x = \frac{-\Delta e_{xa} + \Delta e_{xb} + \Delta e_{xc} - \Delta e_{xd}}{4}$$

(Formula 27)

$$\begin{cases} I_\theta\Delta\theta'' = l_\theta^2\dfrac{\partial F_{xb}}{\partial x_b}\Delta\theta + l_\theta^2\dfrac{\partial F_{xb}}{\partial i_{bl}}\Delta i_\theta + T_\theta \\ (L_{x0} + M_{x0})\Delta i_\theta' = -N\dfrac{\partial \Phi_{bl}}{\partial x_b}\Delta\theta' - R\Delta i_\theta + e_\theta \end{cases}$$

$$\Delta\theta = \frac{-\Delta x_a + \Delta x_b - \Delta x_c + \Delta x_d}{2l_\theta}$$

$$\Delta i_\theta = \frac{-\Delta i_{xa} + \Delta i_{xb} - \Delta i_{xc} + \Delta i_{xd}}{2l_\theta}$$

$$e_\theta = \frac{-\Delta e_{xa} + \Delta e_{xb} - \Delta e_{xc} + \Delta e_{xd}}{2l_\theta}$$

(Formula 28)

$$\begin{cases} I_\xi\Delta\xi'' = l_\theta^2\dfrac{\partial F_{yb}}{\partial y_b}\Delta\xi + l_\theta^2\dfrac{\partial F_{yb}}{\partial i_{bl}}\Delta i_\xi + T_\xi \\ (L_{x0} + M_{x0})\Delta i_\xi' = -N\dfrac{\partial \Phi_{bl}}{\partial y_b}\Delta\xi' - R\Delta i_\xi + e_\xi \end{cases}$$

$$\Delta\xi = \frac{-\Delta y_a - \Delta y_b + \Delta y_c + \Delta y_d}{2l_\theta}$$

$$\Delta i_\xi = \frac{-\Delta i_{ya} - \Delta i_{yb} + \Delta i_{yc} + \Delta i_{yd}}{2l_\theta}$$

$$e_\xi = \frac{-\Delta e_{ya} - \Delta e_{yb} + \Delta e_{yc} + \Delta e_{yd}}{2l_\theta}$$

(Formula 29)

$$\begin{cases} I_\theta\Delta\psi'' = l_\psi^2\dfrac{\partial F_{yb}}{\partial y_b}\Delta\psi + l_\psi^2\dfrac{\partial F_{yb}}{\partial i_{bl}}\Delta i_\psi + T_\psi \\ (L_{x0} + M_{x0})\Delta i_\psi' = -N\dfrac{\partial \Phi_{bl}}{\partial y_b}\Delta\psi' - R\Delta i_\psi + e_\psi \end{cases}$$

$$\Delta\psi = \frac{\Delta y_a - \Delta y_b - \Delta y_c + \Delta y_d}{2l_\psi}$$

$$\Delta i_\psi = \frac{\Delta i_{ya} - \Delta i_{yb} - \Delta i_{yc} + \Delta i_{yd}}{2l_\psi}$$

$$e_\psi = \frac{\Delta e_{ya} - \Delta e_{yb} - \Delta e_{yc} + \Delta e_{yd}}{2l_\psi}$$

With respect to the above formulas, M is a weight of the movable unit 4, $I_\Theta$, $I_\xi$ and $I_\Phi$ are moments of inertia around w A respective y, x and z coordinates, $U_y$ and $U_x$ are the sum of external forces in the respective y-mode and x-mode, $T_\Theta$, $T_\xi$ and $T_\Phi$ are the sum of disturbance torques in the respective θ-mode, ξ-mode and ϕ-mode, a symbol "'" represents a first time differentiation d/dt, a symbol "''" represents a second time differentiation $d^2/dt^2$, Δ is a infinitesimal fluctuation around a steady levitated state, $L_{xo}$ is a self-inductance of each coils 20 and 20' at a steady levitated state, $M_{x0}$ is a mutual inductance of coils 20 and 20', at a steady levitated state, R is a reluctance of each coils 20 and 20', N is the number of turns of each coils 20 and 20', $i_y$, $i_x$, $i_\theta$, $i_\xi$ and $i_\phi$ are excitation currents of the respective y, x, θ, ξ and ϕ modes, $e_y$, $e_x$, $e_\theta$, $e_\xi$ and $e_\phi$ are exciting voltages of the respective y, x, θ, ξ and ϕ modes, $\mathbf{1}_\theta$ is each of the spans of the magnet units 15*a* and 15*d*, and of the magnet units 15*b* and 15*c*, and $\mathbf{1}_\phi$ represents each of the spans of the magnet units 15*a* and 15*b*, and of the magnet units 15*c* and 15*d*.

Moreover, voltage equations of the remaining ζ, δ and γ modes are given as follows.

$$(L_{x0}+M_{x0})\Delta i'_\zeta = -N\frac{\partial\Phi_{b1}}{\partial x_b}\Delta\zeta' - R\Delta i_\zeta + e_\zeta \quad \text{(Formula 30)}$$

$$\Delta\zeta' = \frac{\Delta x_a+\Delta x_b+\Delta x_c+\Delta x_d}{4}$$

$$\Delta i_\zeta = \frac{\Delta i_{xa}+\Delta i_{xb}+\Delta i_{xc}+\Delta i_{xd}}{4}$$

$$e_\zeta = \frac{\Delta e_{xa}+\Delta e_{xb}+\Delta e_{xc}+\Delta e_{xd}}{4}$$

$$(L_{x0}-M_{x0})\Delta i'_\delta = -N\frac{\partial\Phi_{b1}}{\partial y_b}\Delta\delta'' - R\Delta i_\delta + e_\delta \quad \text{(Formula 31)}$$

$$\Delta\delta = \frac{\Delta y_a-\Delta y_b+\Delta y_c-\Delta y_d}{2l_\psi}$$

$$\Delta i_\delta = \frac{\Delta i_{ya}-\Delta i_{yb}+\Delta i_{yc}-\Delta i_{yd}}{2l_\psi}$$

$$e_\delta = \frac{\Delta e_{ya}-\Delta e_{yb}+\Delta e_{yc}-\Delta e_{yd}}{2l_\psi}$$

$$(L_{x0}+M_{x0})\Delta i'_\gamma = -N\frac{\partial\Phi_{b1}}{\partial x_b}\Delta\gamma' - R\Delta i_\gamma + e_\gamma \quad \text{(Formula 32)}$$

$$\Delta\gamma = \frac{\Delta x_a+\Delta x_b-\Delta x_c-\Delta x_d}{2l_\theta}$$

$$\Delta i_\gamma = \frac{\Delta i_{xa}+\Delta i_{xb}-\Delta i_{xc}-\Delta i_{xd}}{2l_\theta}$$

$$e_\gamma = \frac{\Delta e_{xa}+\Delta e_{xb}-\Delta e_{xc}-\Delta e_{xd}}{2l_\theta}$$

With respect to the above formulas, y is a variation of the center of the movable unit 4 in the y-axis direction, x is a variation of the center of the movable unit 4 in the x-axis direction, θ is a rolling angle around y-axis, ξ is a pitching angle around x-axis, ϕ is a yawing angle around z-axis, and symbols y, x, θ, ξ and ϕ of the respective modes are affixed to excitation currents i and exciting voltages e respectively. Further, symbols a~d representing which of the magnet units 15*a*~15*d* are respectively affixed to excitation currents i and exciting voltages e of the magnet units 15*a*~15*d*. Levitation gaps $x_a$~$x_d$ and $y_a$~$y_d$ to the magnet units 15*a*~15*d* are made by a coordinate transformation into y, x, θ, ξ and ϕ coordinates by the following formula 33.

$$y = \frac{1}{4}(y_a+y_b+y_c+y_d) \quad \text{(Formula 33)}$$

$$x = \frac{1}{4}(-x_a+x_b+x_c-x_d)$$

$$\theta = \frac{1}{2l_\theta}(-x_a+x_b-x_c+x_d)$$

$$\xi = \frac{1}{2l_\theta}(-y_a-y_b+y_c+y_d)$$

$$\Psi = \frac{1}{2l_\psi}(y_a-y_b-y_c+y_d)$$

Excitation currents $i_{a1}$, $i_{a2}$~$i_{d1}$, $i_{d2}$ to the magnet units 15*a*~15*d* are made by a coordinate transformation into excitation currents $i_y$, $i_x$, $i_\theta$, $i_\xi$, $i_\phi$, iζ, iδ and iγ of the respective modes by the following formula 34.

$$i_y = \frac{1}{8}(i_{a1}-i_{a2}+i_{b1}-i_{b2}+i_{c1}-i_{c2}+i_{d1}-i_{d2}) \quad \text{(Formula 34)}$$

$$i_x = \frac{1}{8}(-i_{a1}-i_{a2}+i_{b1}+i_{b2}+i_{c1}+i_{c2}-i_{d1}-i_{d2})$$

$$i_\theta = \frac{1}{4l_\theta}(-i_{a1}-i_{a2}+i_{b1}+i_{b2}-i_{c1}-i_{c2}+i_{d1}+i_{d2})$$

$$i_\xi = \frac{1}{4l_\theta}(-i_{a1}+i_{a2}-i_{b1}+i_{b2}+i_{c1}-i_{c2}+i_{d1}-i_{d2})$$

$$i_\psi = \frac{1}{4l_\psi}(i_{a1}-i_{a2}-i_{b1}+i_{b2}-i_{c1}+i_{c2}+i_{d1}-i_{d2})$$

$$i_\zeta = \frac{1}{8}(i_{a1}+i_{a2}+i_{b1}+i_{b2}+i_{c1}+i_{c2}+i_{d1}+i_{d2})$$

$$i_\delta = \frac{1}{4l_\psi}(i_{a1}-i_{a2}-i_{b1}+i_{b2}+i_{c1}-i_{c2}-i_{d1}+i_{d2})$$

$$i_\gamma = \frac{1}{4l_\theta}(i_{a1}+i_{a2}+i_{b1}+i_{b2}-i_{c1}-i_{c2}-i_{d1}-i_{d2})$$

Controlled input signals to levitation systems of the respective modes, that is, exciting voltages $e_y$, $e_x$, $e_\theta$, $e_\xi$, $e_\phi$, $e_\zeta$, $e_\delta$ and $e_\gamma$ which are the outputs of the calculator 32 are made by an inverse transformation to exciting voltages of the coils 20 and 20' of the magnet units 15*a*~15*d* by the following formula 35.

$$e_{a1} = e_y - e_x - \frac{l_\theta}{2}e_\theta - \frac{l_\theta}{2}e_\xi + \frac{l_\psi}{2}e_\psi + e_\zeta + \frac{l_\psi}{2}e_\delta + \frac{l_\theta}{2}e_\gamma \quad \text{(Formula 35)}$$

$$e_{a2} = -e_y - e_x - \frac{l_\theta}{2}e_\theta - \frac{l_\theta}{2}e_\xi - \frac{l_\psi}{2}e_\psi + e_\zeta - \frac{l_\psi}{2}e_\delta + \frac{l_\theta}{2}e_\gamma$$

$$e_{b1} = e_y + e_x + \frac{l_\theta}{2}e_\theta - \frac{l_\theta}{2}e_\xi - \frac{l_\psi}{2}e_\psi + e_\zeta - \frac{l_\psi}{2}e_\delta + \frac{l_\theta}{2}e_\gamma$$

$$e_{b2} = -e_y + e_x + \frac{l_\theta}{2}e_\theta + \frac{l_\theta}{2}e_\xi + \frac{l_\psi}{2}e_\psi + e_\zeta + \frac{l_\psi}{2}e_\delta + \frac{l_\theta}{2}e_\gamma$$

$$e_{c1} = e_y + e_x - \frac{l_\theta}{2}e_\theta + \frac{l_\theta}{2}e_\xi - \frac{l_\psi}{2}e_\psi + e_\zeta + \frac{l_\psi}{2}e_\delta - \frac{l_\theta}{2}e_\gamma$$

$$e_{c2} = -e_y + e_x - \frac{l_\theta}{2}e_\theta - \frac{l_\theta}{2}e_\xi + \frac{l_\psi}{2}e_\psi + e_\zeta - \frac{l_\psi}{2}e_\delta - \frac{l_\theta}{2}e_\gamma$$

$$e_{d1} = e_y - e_x + \frac{l_\theta}{2}e_\theta + \frac{l_\theta}{2}e_\xi + \frac{l_\psi}{2}e_\psi + e_\zeta - \frac{l_\psi}{2}e_\delta - \frac{l_\theta}{2}e_\gamma$$

$$e_{d2} = -e_y - e_x + \frac{l_\theta}{2}e_\theta - \frac{l_\theta}{2}e_\xi - \frac{l_\psi}{2}e_\psi + e_\zeta + \frac{l_\psi}{2}e_\delta - \frac{l_\theta}{2}e_\gamma$$

With respect to the y, x, θ, ξ and ϕ modes, since motion equations of the movable unit 4 pairs with voltage equations thereof, the formulas 25~29 are arranged to an equation of state shown in the following formula 36.

$$X_3' = A_3x_3 + b_3e_3 + d_3u_3 \quad \text{(Formula 36)}$$

In the formula 36, vectors $x_3$, $A_3$, $b_3$ and $d_3$, and $u_3$ are defined as follows.

$$x_3 = \begin{bmatrix}\Delta y\\ \Delta y'\\ \Delta i_y\end{bmatrix}, \begin{bmatrix}\Delta x\\ \Delta x'\\ \Delta i_x\end{bmatrix}, \begin{bmatrix}\Delta\theta\\ \Delta\theta'\\ \Delta i_\theta\end{bmatrix}, \begin{bmatrix}\Delta\xi\\ \Delta\xi'\\ \Delta i_\xi\end{bmatrix} \text{ or } \begin{bmatrix}\Delta\psi\\ \Delta\psi'\\ \Delta i_\psi\end{bmatrix} \quad \text{(Formula 37)}$$

$$A_3 = \begin{bmatrix}0 & 1 & 0\\ a_{21} & 0 & a_{23}\\ 0 & a_{32} & a_{33}\end{bmatrix}$$

-continued $$b_3 = \begin{bmatrix} 0 \\ 0 \\ b_{31} \end{bmatrix}, d_3 = \begin{bmatrix} 0 \\ d_{21} \\ 0 \end{bmatrix}$$

$$u_3 = U_y, U_x, T_\theta, T_\xi, \text{ or } T_\psi$$

Further, $e_3$ is a controlling voltage for stabilizing the respective modes.

$$e_3 = e_y, e_x, e_\theta, e_\xi \text{ or } e_w \quad \text{(Formula 38)}$$

The formulas 30~32 are arranged into an equation of state shown in the following formula 40, by defining a state variable as the following formula 39.

$$x_1 = \Delta i_\zeta, \Delta i_\delta, \Delta i_\gamma \quad \text{(Formula 39)}$$

$$x_l' = A_l x_l + b_l e_l + d_l u_l \quad \text{(Formula 40)}$$

If offset voltages of the controller 32 in the respective modes are marked with $V_\zeta$, $V_\delta$ and $V_\gamma$, the variables $A_1$, $b_1$, $d_1$, and $u_1$ in each mode are presented as follows.

(Formula 41)

($\zeta$-mode)

$$A_l = -\frac{R}{L_{x0} + M_{x0}}, b_l = \frac{1}{L_{x0} + M_{x0}}, d_l = \frac{1}{L_{x0} + M_{x0}}$$

$$u_l = -N\frac{\partial \Phi_{bl}}{\partial x_b}\Delta\zeta' + v_\zeta$$

($\delta$-mode)

$$A_l = -\frac{R}{L_{x0} - M_{x0}}, b_l = \frac{1}{L_{x0} - M_{x0}}, d_l = \frac{1}{L_{x0} - M_{x0}}$$

$$u_l = -N\frac{\partial \Phi_{bl}}{\partial y_b}\Delta\delta' + v_\delta$$

($\gamma$-mode)

$$A_l = -\frac{R}{L_{x0} + M_{x0}}, b_l = \frac{1}{L_{x0} + M_{x0}}, d_l = \frac{1}{L_{x0} + M_{x0}}$$

$$u_l = -N\frac{\partial \Phi_{bl}}{\partial x_b}\Delta\gamma' + v_\gamma$$

The term $e_1$ is a controlling voltage of each mode.

$$e_l = e_\zeta, e_\delta, \text{ or } e_\gamma \quad \text{(Formula 42)}$$

The formula 36 may achieve a zero power control by feedback of the following formula 43.

$$e_3 = F_3 x_3 + \int K_3 x_3 dt \quad \text{(Formula 43)}$$

In case of letting $F_a$, $F_b$, $F_c$ be proportional gains, and $K_c$ be integral gain, the following formula 44 is given.

$$F_3 = [F_a F_b F_c] \quad \text{(Formula 44)}$$

$$K_3 = [0\ 0\ K_c]$$

Likewise, the formula 40 may achieve a zero power control by feedback of the following formula 45.

$$e_l = F_l x_l + \int K_l x_l dt \quad \text{(Formula 45)}$$

$F_1$ is a proportional gain. $K_1$ is an integral gain.

As shown in FIG. 6, the calculator 32, which achieves the above zero power control, includes subtractors 41*a*~41*h*, 42*a* ~42*h* and 43*a*~43*h*, average calculators 44*x* and 44*y*, a gap deviation coordinate transformation circuit 45, a current deviation coordinate transformation circuit 46, a controlling voltage calculator 47, and a controlling voltage coordinate inverse transformation circuit 48. For the following explanation, the gap deviation coordinate transformation circuit 45, the current deviation coordinate transformation circuit 46, the controlling voltage calculator 47, and the controlling voltage coordinate inverse transformation circuit 48 are treated as a guide controller 50.

The subtractors 41*a*~41*h* calculate x-direction gap deviation signals $\Delta_{gxa1}$, $\Delta_{gxa2}$,~$\Delta_{gxd1}$, $\Delta_{gxd2}$ by subtracting the respective reference values $X_{a01}$, $X_{a02}$,$X_{d01}$, $X_{d02}$ from gap signals $g_{xa1}$, $g_{xa2}$,$g_{xd1}$, $g_{xd2}$ from the x-direction gap sensors 13*a*, 13'*a*~13*d*, 13'*d*. The subtractors 42*a*~42*h* calculate y-direction gap deviation signals $\Delta g_{ya1}$, $\Delta g_{ya2}$, $\Delta g_{yd1}$, $\Delta g_{yd2}$ by subtracting the respective reference values $Y_{a01}$, $Y_{a02}$, ~$Y_{d01}$, Y*d02* from gap signals $g_{ya1}$, $g_{ya2}$, ~$g_{yd1}$, $g_{yd2}$ from the y-direction gap sensors 14*a*, 14'*a*~14*d*, 14'*d*. The subtractors 43*a*~43*h* calculate current deviation signals $\Delta i_{a1}$, $\Delta i_{a2}$, $\Delta i_{d1}$, $\Delta i_{d2}$ by subtracting the respective reference values $i_{a01}$, $i_{a02}$,~$i_{d01}$, $i_{d02}$ from excitation current signals $i_{a1}$, $i_{a2}$,~$i_{d1}$, $i_{d2}$ from current detectors 36*a*, 36'*a*~36*d*, 36'*d*.

The average calculators 44*x* and 44*y* average the x-direction gap deviation signals $\Delta g_{xa1}$, $\Delta g_{xa2}$, $\Delta g_{xd1}$, $\Delta g_{xd2}$, and the y-direction gap deviation signals $\Delta g_{ya1}$, $\Delta g_{ya2}$, ~$\Delta g_{yd1}$, $\Delta g_{yd2}$respectively, and output the calculated x-direction gap deviation signals $\Delta xa$~$\Delta x_d$, and the calculated y-direction gap deviation signals $\Delta y_a$~$\Delta y_d$.

The gap deviation coordinate transformation circuit 45 calculates y-direction variation $\Delta y$ of the center of the movable unit 4 on the basis of the y-direction gap deviation signals $\Delta ya$~$\Delta y_d$, x-direction variation $\Delta x$ of the center of the movable unit 4 on the basis of the x-direction gap deviation signals $\Delta x_a$~$\Delta\Delta x_d$, a rotation angle $\Delta\theta$ in the $\theta$-direction (rolling direction) of the center of the movable unit 4, a rotation angle $\Delta\xi$ in the $\xi$-direction(pitching direction) of the movable unit 4, and a rotation angled $\Delta\phi$ in the $\phi$-direction (yawing direction) of the movable unit 4, by the use of the formula 33.

The current deviation coordinate transformation circuit 46 calculates a current deviation $\Delta i_y$ regarding y-direction movement of the center of the movable unit 4, a current deviation $\Delta i_x$ regarding x-direction movement of the center of the movable unit 4, a current deviation $\Delta i_\theta$ regarding a rolling around the center of the movable unit 4, a current deviation $\Delta i_\xi$ regarding a pitching around the center of the movable unit 4, a current deviation $\Delta i_\phi$ in regarding a yawing around the center of the movable unit 4, and current deviations $\Delta i_\zeta$, $\Delta i_\gamma$ and $\Delta i_\gamma$ regarding $\zeta$, $\delta$ and $\gamma$ stressing the movable unit 4, on the basis of the current deviation signals $\Delta i_{a1}$, $\Delta i_{a2}$,~$\Delta i_{d1}$, $\Delta i_{d2}$ by using the formula 34.

The controlling voltage calculator 47 calculates controlling voltages $e_y$, $e_x$, $e_\theta$, $e_\xi$, $e_\phi$, $e_\zeta$, $e_\delta$ and $e_\gamma$ for magnetically and securely levitating the movable unit 4 in each of the y, x, $\theta$, $\xi$, $\phi$, $\zeta$, $\delta$ and $\gamma$ modes on the basis of the outputs $\Delta y$, $\Delta x$, $\Delta\theta$, $\Delta\xi$, $\Delta\phi$, $\Delta i_y$, $\Delta i_x$, $\Delta i_\theta$, $\Delta i_\xi$, $\Delta i_\phi$, $\Delta i_\zeta$, $\Delta i_\delta$ and $\Delta i_\gamma$ of the gap deviation coordinate transformation circuit 45 and the current deviation coordinate transformation circuit 46. The controlling voltage coordinate inverse transformation circuit 48 calculates respective exciting voltages $e_{a1}$, $e_{a2}$, $e_{d1}$, $e_{d2}$ of the magnet units 15*a*~15*d* on the basis of the outputs $e_y$, $e_x$, $e_\theta$, $e_\xi$, $e_\phi$, $e_\zeta$, $e_\delta$ and $e_\gamma$ by the use of the formula 35, and feeds back the calculated result to the power amplifiers 33*a*, 33'*a*~33*d*, 33'*d*.

The controlling voltage calculator 47 includes a back and forth mode calculator 47*a*, a right and left mode calculator 47*b*, a roll mode calculator 47*c*, a pitch mode calculator 47*d*, a yaw mode calculator 47*e*, an attractive mode calculator 47*f*, a torsion mode calculator 47*g*, and a strain mode calculator 47*h*.

The back and forth mode calculator 47*a* calculates an exciting voltage $e_y$ in the y-mode on the basis of the formula 43 by using inputs $\Delta y$ and $\Delta i_y$. The right and left mode calculator 47*b* calculates an exciting voltage $e_x$ in the x-mode on the basis of the formula 43 by using inputs $\Delta x$ and $\Delta i_x$. The roll mode calculator 47*c* calculates an exciting voltage $e\theta$ in the θ-mode on the basis of the formula 43 by using inputs $\Delta\theta$ and $\Delta i_\theta$. The pitch mode calculator 47*d* calculates an exciting voltage et in the ξ-mode on the basis of the formula 43 by using inputs $\Delta\xi$ and $\Delta i_\xi$. The yaw mode calculator 47*e* calculates an exciting voltage $e_\phi$ in the θ-mode on the basis of the formula 43 by using inputs $\Delta\phi$ and $\Delta i_\phi$. The attractive mode calculator 47*f* calculates an exciting voltage $e_\zeta$ in the ζ-mode on the basis of the formula 45 by using input $\Delta i_\zeta$. The torsion mode calculator 47*g* calculates an exciting voltage $_\delta$ in the δ-mode on the basis of the formula 45 by using input $\Delta i_\delta$. The strain mode calculator 47*h* calculates an exciting voltage $e_\gamma$ in the γ-mode on the basis of the formula 45 by using input $\Delta i_\gamma$.

Figure 7:
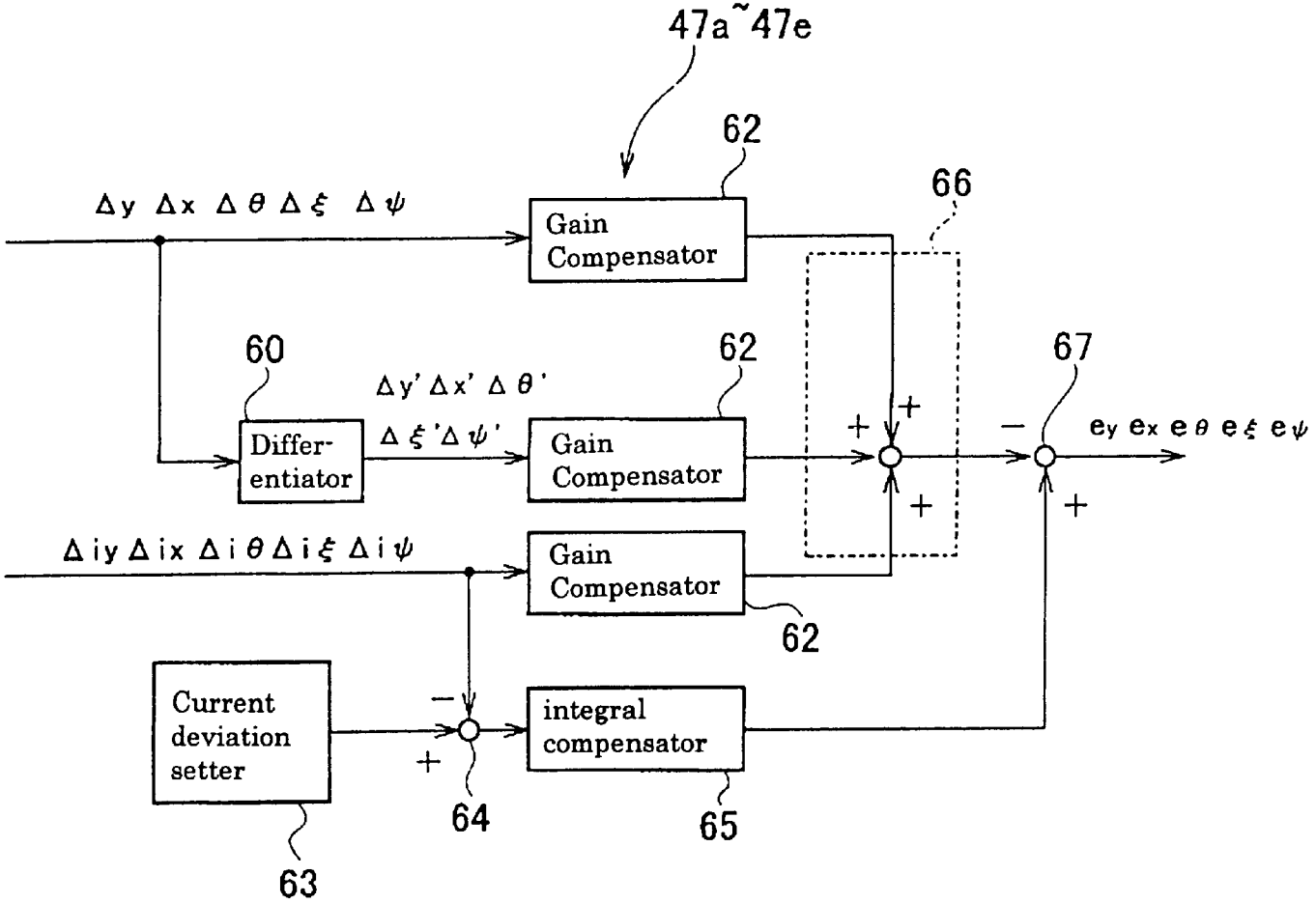
FIG. 7 is a block diagram showing a circuit of a controlling voltage calculator of the controller.

FIG. 7 shows in detail each of the calculators 47*a*~47*e*.

Each of the calculators 47*a*~47*e* includes a differentiator 60 calculating time change rate $\Delta y'$, $\Delta x'$, $\Delta\theta'$, $\Delta\xi'$ or $\Delta\phi'$ on the basis of each of the variations $\Delta y$, $\Delta x$, $\Delta\theta$, $\Delta\xi$ and $\Delta\phi$, gain compensators 62 multiplying each of the variations $\Delta y$~$\Delta\phi$, each of the time change rates $\Delta y'$~$\Delta\phi'$ and each of the current deviations $\Delta i_y$~$\Delta i_\phi$, by an appropriate feedback gain respectively, a current deviation setter 63, a subtractor 64 subtracting each of the current deviations $\Delta i_y$~$\Delta i_\phi$ from a reference value output by the current deviation setter 63, an integral compensator 65 integrating the output of the subtractor 64 and multiplying the integrated result by an appropriate feed back gain, an adder 66 calculating the sum of the outputs of the gain compensators 62, and a subtractor 67 subtracting the output of the adder 66 from the output of the integral compensator 65, and outputting the exciting voltage $e_y$, $e_x$, $e_\theta$, $e_\xi$ or $e_\phi$, of the respective y, x, θ, ξ and φ modes.

Figure 8:
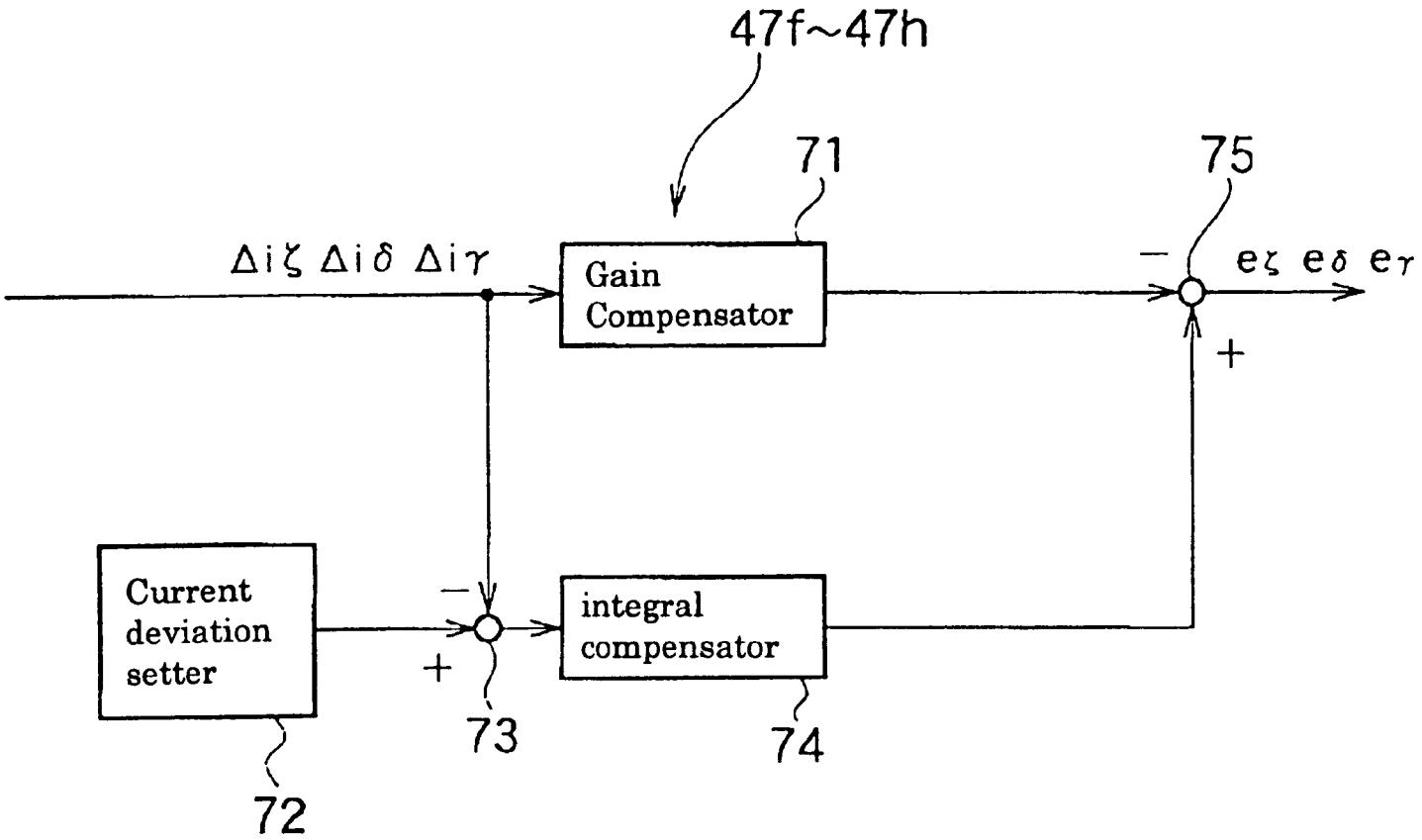
FIG. 8 is a block diagram showing a circuit of another controlling voltage calculator of the controller.

FIG. 8 shows components in common among the calculators 47*f*~47*h*.

Each of the calculators 47*f*~47*h* is composed of a gain compensator 71 multiplying the current deviation $\Delta i_\zeta$, $\Delta i_\delta$ or $\Delta i_y$ by an appropriate feedback gain, a current deviation setter 72, a subtractor 73 subtracting the current deviation $\Delta i_\zeta$, $\Delta i_\delta$ or $\Delta i_\gamma$ from a reference value output by the current deviation setter 72, an integral compensator 74 integrating the output of the subtractor 73 and multiplying the integrated result by an appropriate feedback gain, and a subtractor 75 subtracting the output of the gain compensator 71 from the output of the integral compensator 74 and outputting an exciting voltage $e_\zeta$, $e_\delta$ or $e_\gamma$ of the respective ζ, δ and γ modes.

The following is an operation of the above described elevator magnetic guide unit of the first embodiment of the present invention.

Any of the ends of the center cores 16 of the magnet units 15*a*~15*d*, or the ends of the electromagnets 18 and 18' of the magnet units 15*a*~15*d* adsorb to facing surfaces of the guide rails 2 and 2' through the solid lubricating materials 22 at a stopping state of the magnetic guide system. At this time, an upward and downward movement of the movable unit 4 is not impeded because of the effect of the solid lubricating materials 22.

Once the guide system is activated at the stopping state, fluxes of the electromagnets 18 and 18', which possesses the same or opposite direction of fluxes generated by the permanent magnets 17 and 17', are controlled by the guide controller 50 of the controller 30. The guide controller 50 controls excitation currents to the coils 20 and 20' in order to keep a predetermined gap between the magnet units 15*a*~15*d* and guide rails 2 and 2'. Consequently, as shown in FIGS. 4 and 5, a magnetic circuit Mcb is formed with a path of the permanent magnet 17~the L-shaped core 19~the core plate 21~the gap Gb~the guide rail 2'~the gap Gb"~the center core 16~the permanent magnet 17, a magnetic circuit Mcb' is formed with a path of the permanent magnet 17'~the L-shaped core 19'~the core plate 21'~the gap Gb'~the guide rail 2'~the gap Gb"~the center core 16~the permanent magnet 17'. The gaps Gb, Gb' and Gb", or other gaps formed with the magnet units 15*a*, 15*c* and 15*d*, are set to certain distances so that magnetic attractive forces of the magnet units 15*a*~15*d* generated by the permanent magnets 17 and 17' balance with a force in the y-direction (back and force direction) acting on the center of the movable unit 4, a force in the x-direction(right and left direction), and torques acting around the x, y and x-axis passing on the center of the movable unit 4. When some external forces operate on the movable unit 4, the controller 30 controls excitation currents flowing into the electromagnets 18 and 18' of the respective magnet units 15*a*~15*d* in order to keep such balance, thereby achieving the so-called zero power control Even if a shake of the movable unit 4 is made due to movements of passengers or irregularities on the guide rails 2 and 2' while the movable unit 4, which is controlled to be guided with no contact by the zero power control, is moved upwardly by a hoisting machine (not shown), the shake may be restrained by promptly controlling attractive forces generated by the magnet units 15*a*~15*d* by excitation of the electromagnets 18 and 18', since the magnet units 15*a*~15*d* possess the permanent magnets 17 and 17' having common magnetic paths with the electromagnets 18 and 18' within the gaps Gb, Gb' and Gb".

Further, even if the gaps Gb, Gb' and Gb" are set large, the quality of no contact guide control does not become worse, because permanent magnets having a large residual magnetic flux density and coersive force are adopted. As a result, the guide system may obtain a large stroke and low rigidity for the guide control, and achieve a comfortable ride.

Moreover, since each of the magnet units 15*a*~15*d* is disposed so that magnetic poles face each other putting the guide rail 2 or 2' between the magnetic poles, attractive forces, which are generated by the magnetic poles, operating on the guide rail 2 or 2', are cancelled entirely or in part, whereby a large attractive force does not operate on the guide rails 2 and 2'. Accordingly, since a large attractive force in the only one direction caused by the magnet unit does not operate on the guide rails 2 and 2', an installed position of the guide rail 2 or 2' is difficult to be shifted, and a difference in level at the joint 80 of the guide rails 2 and 2', and a straight performance of the guide rail 2 or 2' do not get worse. As a result, strength for installation of the guide rails 2 and 2' maybe reduced, thereby reducing a cost of an elevator system.

In case the magnetic guide system stops working, current deviation setters 62 for they-mode and the x-mode set reference values from zero to minus values gradually, whereby the movable unit 4 gradually moves in the y and x-directions. At last, any of the ends of the center cores 16 of the magnet units 15*a*~15*d*, or the ends of the electromagnets 18 and 18' of the magnet units 15*a*~15*d* adsorb to facing surfaces of the guide rails 2 and 2' through the solid lubricating materials 22. If the magnetic guide system is stopped at this state, a reference value of the current deviation setter 62 is reset to zero, and the movable unit 4 adsorbs to the guide rails 2 and 2'.

In the first embodiment, although the zero power control, which controls to settle an excitation current for an electromagnet to zero at a steady state, is adopted for no contact guide control, various other control methods for controlling attractive forces of the magnet units 15*a*~15*d* may be used. For example, a control method, which controls to keep the gaps constant, may be adopted, if the magnet units is required to follow the guide rails 2 and 2' more strictly.

Figure 9:
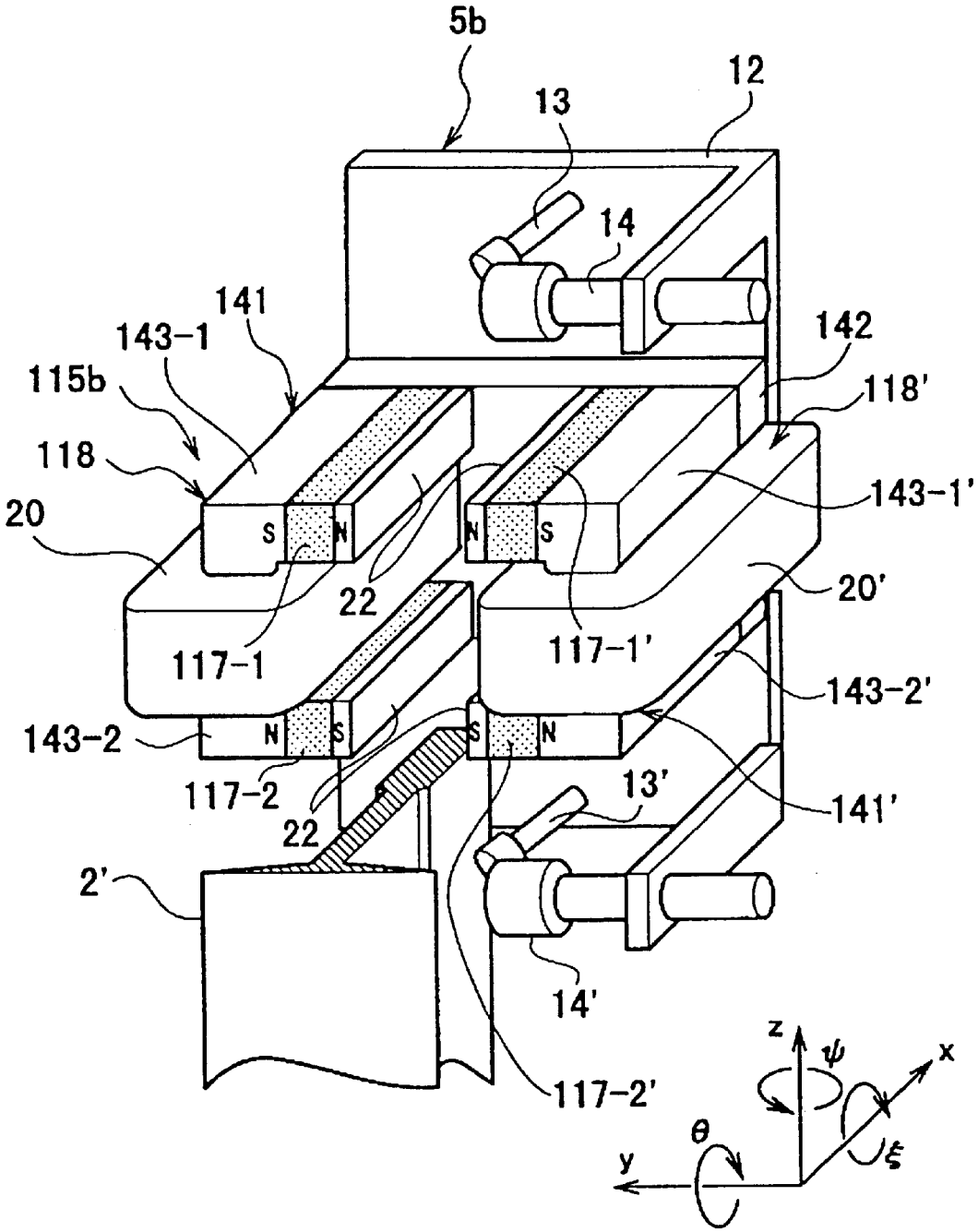
FIG. 9 is a perspective view showing a structure of a magnet unit of a magnetic guide system of a second embodiment.
Figure 10:
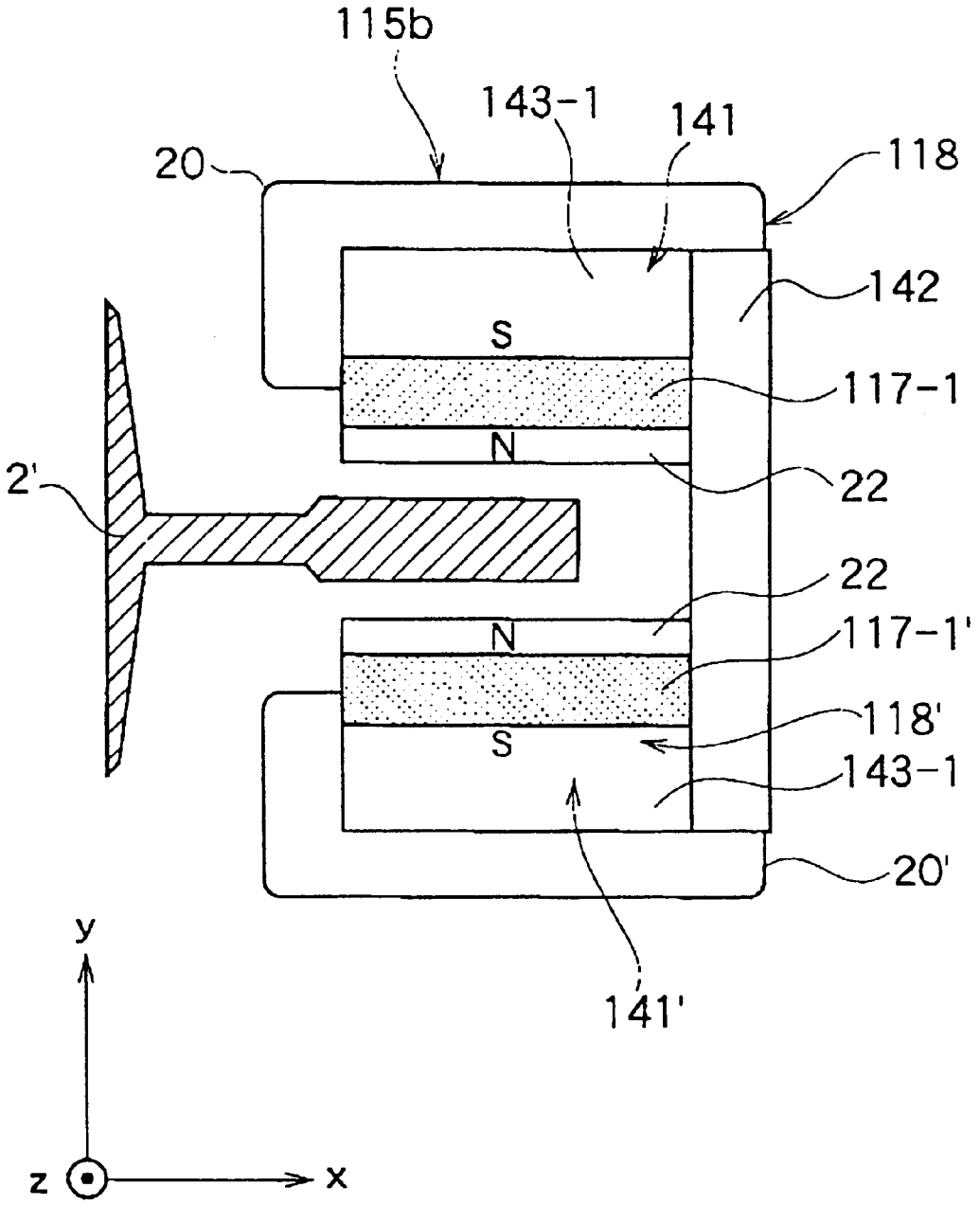
FIG. 10 is a plan view showing the magnet unit of the second embodiment.

A magnetic guide system of a second embodiment of the present invention is described on the basis of FIGS. 9 and 10.

In the first embodiment, although no contact guide control is achieved by adopting the E-shaped magnet units 15*a*~15*d* as guide units 5*a*~5*d*, it is not limited to the above described system. As shown in FIGS. 9 and 10, two U-shaped combined magnets 141 and 141' are disposed so that magnetic poles of the combined magnets 141 and 141' face to the guide rails 2 and 2' in part, and the same poles of the combined magnets 141 and 141' face one another putting the guide rails 2 and 2' between the magnetic poles. The U-shaped combined magnet 141 includes two permanent magnets 117-1 and 117-2, and an electromagnet 118. Likewise, the U-shaped combined magnet 141' includes two permanent magnets 117-1' and 117-2', and an electromagnet 118'. The U-shaped combined magnets 141 and 141' constitute respective magnet units 115*a*~115*d*. In the following explanation, the same numerals are suffixed to common components with the first embodiment for convenience.

The magnet unit 115*b* shown in FIGS. 9 and 10 includes a pair of combined magnets 141 and 141', and a base 142 made of non-magnetic materials in the shape of an H for installing the combined magnets 141 and 141' on a base 12 in order for the coils 20 and 20' not to interfere with the base 12, and in order for the same poles of the combined magnets 141 and 141' to be disposed to face one another.

The combined magnet 141 includes a U-shaped electromagnet 118 formed with two symmetrical L-shaped cores 143-1 and 143-2 putting the coil 20 therebetween, and permanent magnets 117-1 and 117-2 adhered to the opposite ends of the respective magnetic poles of the electromagnet 118. Likewise, the combined magnet 141' includes a U-shaped electromagnet 118' formed with two symmetrical L-shaped cores 143-1' and 143-2' putting the coil 20' therebetween, and permanent magnets 117-1' and 117-2' adhered to the opposite ends of the respective magnetic poles of the electromagnet 118'. The permanent magnets 117-1 and 117-2 adhered to the opposite ends of the respective magnetic poles of the electromagnet 118 so that one of the magnetic poles of the combined magnet 141 become the other magnetic pole one another. In the same way as the first embodiment, the ends of the magnet unit 115*b*, that is, the ends of the permanent magnets 117-1 and 117-2 include the solid lubricating materials 22. The magnet unit 115 butilizes a magnetic allying force operating on the guide rail 2 as a guiding force in the x-direction.

With respect to the magnet unit 115*b* of the second embodiment, a magnetic attractive force in the x-direction operating to peeling of the guide rail 2 from a hoistway wall is smaller than that of the E-shaped magnet unit 15*b*. Further, in the same way as the first embodiment, since magnetic poles of the combined magnets 141 and 141' face each other putting the guide rail 2 or 2' between the magnetic poles, attractive forces, which are generated by the magnetic poles, operating on the guide rail 2 or 2', are cancelled entirely or in part, whereby a large attractive force does not operate on the guide rails 2 and 2'. Accordingly, since a large attractive force in the only one direction caused by the magnet unit does not operate on the guide rails 2 and 2', an installed position of the guide rail 2 or 2' is difficult to be shifted, and a difference in level at the joint 80 of the guide rails 2 and 2', and a straight performance of the guide rail 2 or 2' do not get worse. As a result, strength for installation of the guide rails 2 and 2' may be reduced, thereby reducing a cost of an elevator system.

Figure 11:
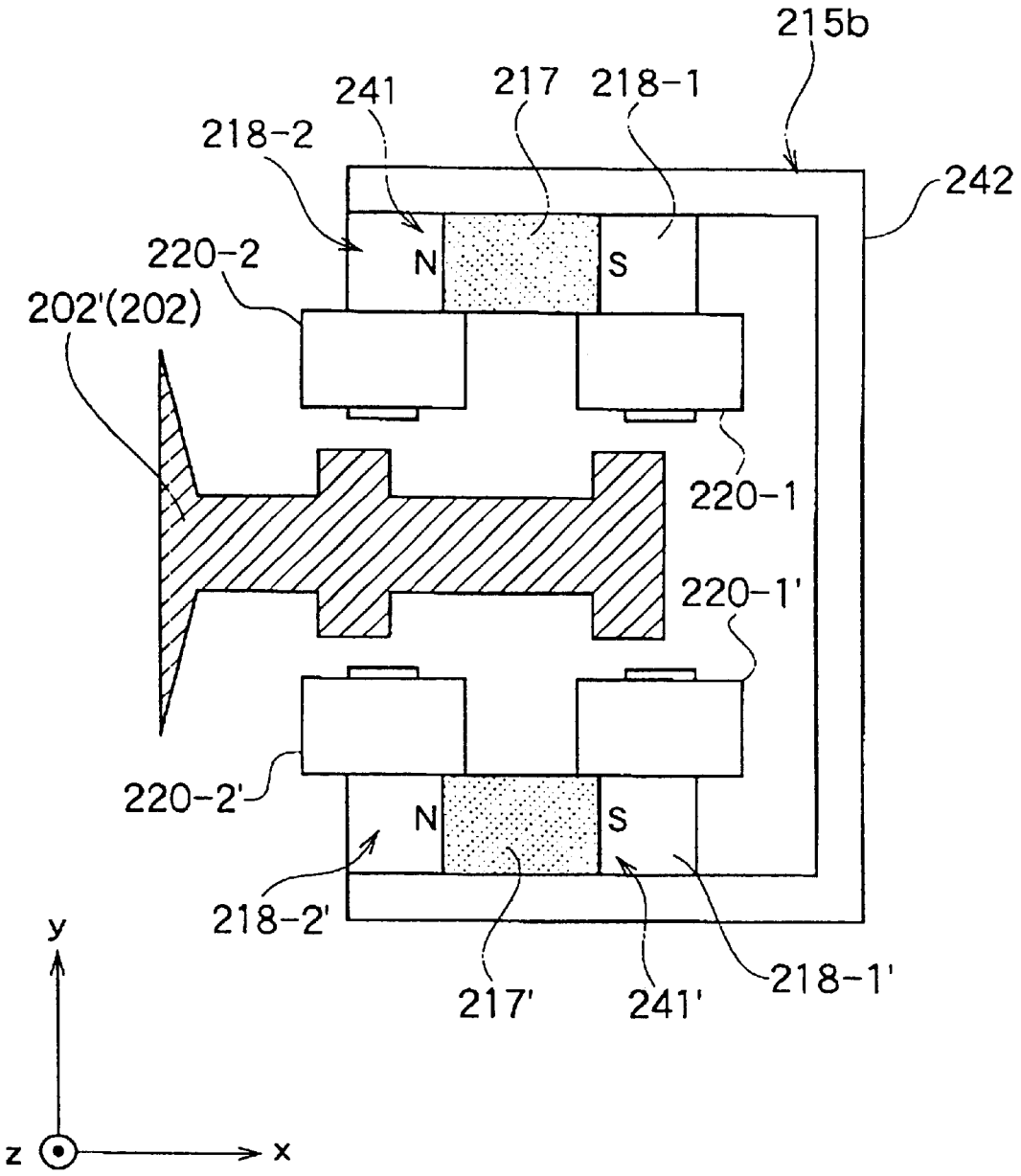
FIG. 11 is plan view showing a structure of a magnet unit of a magnetic guide system of a third embodiment.

A magnetic guide system of a third embodiment of the present invention is described on the basis of FIG. 11.

In the first and second embodiments, a horizontal sectional form of the guide rails 2 or 2' is formed in the shape of an I, while each of guide rails 202 and 202' possesses a portion having an H-shaped horizontal sectional form, facing one of magnet units 215*a*~215*d* (only 215*b* is shown in FIG. 11), and the portion is formed with projecting portions facing magnetic poles of the magnet units 215*a*~215*d* in the third embodiment shown in FIG. 11.

The magnet unit 215*b* being guided by the guide rail 202' is fixed to a base 242 made of non-magnetic materials and formed in the shape of a U. Magnetic poles of a U-shaped combined magnet 241 face the respective same magnetic poles of a U-shaped combined magnet 241' putting the projecting portions of the guide rail 2 between the respective magnetic poles. Each center of the magnetic poles of the combined magnet 241 or 241' is off each center of the projecting portions of the guide rail 2 or 2' in order to obtain a guiding force in the x-direction.

The combined magnet 241 includes two electromagnets 218-1 and 218-2, and a permanent magnet 217 disposed between the electro magnets 218-1 and 218-2. Likewise, the combined magnet 241' includes two electromagnets 218-1' and 218-2', and a permanent magnet 217' disposed between the electromagnets 218-1' and 218-2'. The electromagnets 218-1, 218-2, 218-1' and 218-2' include coils 220-1, 220-2, 220-1' and 220-2' respectively. The respective two coils 220-1 and 220-2, or 220-1' and 220-2' of the combined magnets 241 and 241' are made a circuit so as to increase or decrease fluxes generated by the permanent magnets 217 and 217' by excitation.

The magnet units 215*a*~215*d* of the third embodiment possesses a stronger guiding force in the x-direction compared with the magnet unit 115*a*~115*d* of the second embodiment shown in FIGS. 9 and 10.

Structure of a magnet unit is not limited to the above described embodiments. A magnet unit having at least magnetic poles facing each other putting a guide rail therebetween may be adopted. Moreover, a sectional form of a guide rail is not limited to the above described embodiments. A guide rail having any one of horizontal sectional forms of a round shape, an elliptic shape and a rectangular shape may be adopted.

In the above embodiments, although a condition of the magnetic circuit formed with the magnet unit and the guide rail is detected by measuring a gap calculated by an average of outputs of gap sensors, and an excitation current detected by current detectors, a method of measuring a gap, a use of a gap sensor and a use of a current detector are not limited. Other methods, which may detect a condition of the magnetic circuit formed with the magnet unit and the guide rail, may be adopted.

Further, in the above embodiments, although a controller for a magnetic levitation control is described as an analog control, either analog control or digital control maybe adopted. Furthermore, a power amplification system is not limited likewise, a current type system, or a PWM type system may be adopted.

According to the magnetic guide system of the present invention, since the magnet unit is provided with the permanent magnet having a common magnetic path with the electromagnet at the gap formed with the magnet unit and the guide rail, partial differential terms $\partial f/\partial x$ and $\partial f/\partial i$ do not become zero where f is an attractive force of the magnet unit, x is a gap, and i is an excitation current, even if an excitation current is made zero when a guiding force is not needed at a steady state of the movable unit, thereby enabling to design a linear control system.

Since a common magnetic path of the permanent magnet and the electromagnet is formed at the gap, a guide system possessing a high control performance and a low rigidity can be achieved.

Further, since magnetic poles of the magnet unit face each other putting the guide rail between the magnetic poles, attractive forces, which are generated by the magnetic poles, operating on the guide rail, are cancelled entirely or in part, whereby a large attractive force does not operate on the guide rail. Accordingly, since a large attractive force in the only one direction caused by the magnet unit does not operate on the guide rail, an installed position of the guide rail is difficult to be shifted, and a difference in level at the joint of the guide rail, and a straight performance of the guide rail do not get worse. As a result, the strength for installation of the guide rail maybe reduced, thereby reducing a cost of an elevator system.

Various modifications and variations are possible in light of the above teachings. Therefore, it is to be understood that within the scope of the appended claims, the present invention may be practiced otherwise than as specifically described herein.

What is claimed is:

1. A magnetic guide system for an elevator, comprising:

a movable unit configured to move along a guide rail;

a magnet unit attached to said movable unit; said magnet unit comprises, a plurality of electromagnets having magnetic poles facing said guide rail with a gap, at least two of said magnetic poles are disposed to operate attractive forces in opposite directions to each other on said guide rail, and a permanent magnet providing a magnetomotive force for guiding said movable unit, and forming a common magnetic circuit with one of said electromagnets at said gap, a sensor configured to detect a condition of said common magnetic circuit formed with said magnet unit and said guide rail; and a guide controller configured to control excitation currents to said electromagnets in response to an output of said sensor so as to stabilize said magnetic circuit.

2. The magnetic guide system as recited in claim 1, wherein said guide controller stabilizes said magnetic circuit so that said excitation currents converge to zero when said movable unit stays at a steady state.

3. The magnetic guide system as recited in claim 1, wherein at least two of said magnet poles have different poles from each other, and generate fluxes operating on said guide rail and crossing at right angles to each other.

4. The magnetic guide system as recited in claim 3, wherein said magnet unit comprises, at least two of said magnetic poles having the same poles and facing each other putting said guide rail between said two -of said magnetic poles, and at least one of said magnetic poles, disposed in the middle of said two of said magnetic poles, being a different pole from said two of said magnetic poles, said magnet unit is formed in the shape of an E as a whole.

5. The magnetic guide system as recited in claim 1, wherein said magnet unit comprises at least two of said magnetic poles facing each other putting said guide rail between said two of said magnetic poles, and operates attractive force on said guide rail in both the facing direction and a right-angled direction of said facing direction.

6. The magnetic guide system as recited in claim 5, wherein said magnet unit comprises a pair of U-shaped combined magnets formed with said electromagnets and said permanent magnet respectively.

7. The magnetic guide system as recited in claim 5, wherein said guide rail is provided with projecting portions facing said magnetic poles.

8. The magnetic guide system as recited in claim 1, wherein said sensor detects a position relationship on a horizontal plane between said magnet unit and said guide rail.

9. The magnetic guide system as recited in claim 1, wherein said sensor detects excitation currents to said electromagnets.

10. A magnetic guide system for an elevator, comprising:

a movable unit adapted to move along a guide rail;

a magnetic unit coupled to said movable unit and including a plurality of electromagnets having magnetic poles oriented toward said guide rail and having a gap, at least two of said magnetic poles are disposed to provide attractive forces in opposite directions to said guide rail, and also including a permanent magnet oriented to provide a magnetic field to guide said movable unit, said permanent magnet and at least one of said plurality electromagnets forming a magnetic circuit at said gap;

a sensor coupled to said magnetic circuit to detect a state of said gap; and a controller coupled to the electromagnets to provide excitation currents thereto in response to the detected state of said gap to alter said attractive forces of said at least two of said magnetic poles to maintain a steady state condition of said movable unit.

* * * * *